US011186112B1

(12) United States Patent
Hersch

(10) Patent No.: US 11,186,112 B1
(45) Date of Patent: Nov. 30, 2021

(54) SYNTHESIS OF CURVED SURFACE MOIRÉ

(71) Applicant: Roger D. Hersch, Epalinges (CH)

(72) Inventor: Roger D. Hersch, Epalinges (CH)

(73) Assignee: Innoview ARL, Epalinges (CH)

( * ) Notice: Subject to any disclaimer, the term of this patent is extended or adjusted under 35 U.S.C. 154(b) by 0 days.

(21) Appl. No.: 16/881,396

(22) Filed: May 22, 2020

(51) Int. Cl.
*B42D 25/342* (2014.01)
*G07D 7/207* (2016.01)
*G07D 7/00* (2016.01)

(52) U.S. Cl.
CPC ..... *B42D 25/342* (2014.10); *G07D 7/0032* (2017.05); *G07D 7/207* (2017.05)

(58) Field of Classification Search
CPC .... B42D 25/342; G07D 7/207; G07D 7/0032; G07D 7/00
USPC ..... 283/67, 70, 72, 74, 94, 98, 901
See application file for complete search history.

(56) References Cited

U.S. PATENT DOCUMENTS

| | | | | |
|---|---|---|---|---|
| 6,249,588 | B1 | 6/2001 | Amidror | |
| 6,819,775 | B2 | 11/2004 | Amidror | |
| 7,194,105 | B2 | 3/2007 | Hersch | |
| 7,295,717 | B2 | 11/2007 | Hersch et al. | |
| 7,305,105 | B2 | 12/2007 | Chosson | |
| 7,710,551 | B2 | 5/2010 | Hersch | |
| 7,751,608 | B2 | 7/2010 | Hersch | |
| 10,286,716 | B2 | 5/2019 | Hersch et al. | |
| 2010/0277806 | A1* | 11/2010 | Lundvall | G02B 30/27 359/622 |

OTHER PUBLICATIONS

T. Walger; T. Besson; V. Flauraud; R. D. Hersch; J. Brugger, "1D moiré shapes by superposed layers of micro-lenses", Optics Express. Dec. 23, 2019, vol. 27, No. 26, p. 37419-37434.

T. Walger; T. Besson; V. Flauraud; R. D. Hersch; J. Brugger, Level-line moires by superposition of cylindrical microlens gratings, Journal of the Optical Society of America. Jan. 10, 2020. vol. A37, No. 2, p. 209-218.

R.D. Hersch and S. Chosson, Band Moire Images, Proc. SIGGRAPH 2004, ACM Trans. on Graphics, vol. 23, No. 3, 239-248 (2004).

S. Chosson, R.D. Hersch, Beating Shapes Relying on Moiré Level Lines, ACM Transactions on Graphics (TOG), vol. 34 No. 1, Article No. 9, 1-10 (2014).

(Continued)

*Primary Examiner* — Justin V Lewis

(57) ABSTRACT

The present disclosure describes a method and computerized means for creating dynamically evolving moiré shapes on curved surfaces. The method applies geometrical transformations in order to obtain curvilinear moirés and creates the moirés on curved surfaces by applying mappings from planar space to 3D space. The method relies on the superposition of a base layer with base bands and of a revealing layer with sampling elements. The dimensions of the revealing layer sampling elements such as cylindrical or spherical lenses as well as the distances between the base and revealing layer surfaces are adapted to the space between neighbouring isoparametric lines that define the curved surface. The resulting moiré shapes evolve smoothly on the specified curved surface and show recognizable shapes such as words, letters, numbers, flags, logos, graphic motifs, drawings, clip art, and faces.

18 Claims, 17 Drawing Sheets

(56) References Cited

OTHER PUBLICATIONS

H. Kamal, R. Volkel, J. Alda, Properties of the moiré magnifiers, Optical Engineering, vol. 37, No. 11, pp. 3007-3014 (1998).
I. Amidror, The theory of the moiré phenomenon, 2nd edition, vol. 1, Section 4.4, The special case of the (1,0,-1,0)-moiré, pp. 96-108, (2009).
S. Chosson, "Synthese d'images moiré" (in English: Synthesis of moire images), EPFL Thesis 3434, 2006, pp. 111-112.
G. Oster, "Optical Art", vol. 4, No. 11, 1965, pp. 1359-1369.

* cited by examiner $\eta = \pi/4 - \theta/2$ $PN/(2R) = \sin(\eta)$

SYNTHESIS OF CURVED SURFACE MOIRÉ

The present invention is related to the following US patents, with present inventor Hersch being also inventor in the patents mentioned below.

(a) U.S. Pat. No. 7,194,105, filed Oct. 16, 2002, entitled "Authentication of documents and articles by moiré patterns", inventors Hersch and Chosson, (category: 1D moiré);

(b) U.S. Pat. No. 7,751,608, filed 30 of Jun. 2004 entitled "Model-based synthesis of band moiré images for authenticating security documents and valuable products", inventors Hersch and Chosson, herein incorporated by reference; (category: 1D moiré);

(c) U.S. Pat. No. 7,710,551, filed Feb. 9, 2006, entitled "Model-based synthesis of band moiré images for authentication purposes", inventors Hersch and Chosson (category: 1D moiré);

(d) U.S. Pat. No. 7,295,717, filed Oct. 30, 2006, "Synthesis of superposition images for watches, valuable articles and publicity", inventors Hersch, Chosson, Seri and Fehr, (categories: 1D moiré and level-line moiré), herein incorporated by reference;

(e) U.S. Pat. No. 7,305,105 filed Jun. 10, 2005, entitled "Authentication of secure items by shape level lines", inventors Chosson and Hersch (category: level-line moiré), herein incorporated by reference;

(f) U.S. Pat. No. 6,249,588 filed Aug. 28, 1995, entitled "Method and apparatus for authentication of documents by using the intensity profile of moiré patterns", inventors Amidror and Hersch (category 2D moiré);

(g) U.S. Pat. No. 6,819,775, filed Jun. 11, 2001, entitled "Authentication of documents and valuable articles by using moiré intensity profiles", inventors Amidror and Hersch, herein incorporated by reference (category 2D moiré), herein incorporated by reference.

(h) U.S. Pat. No. 10,286,716, filed Oct. 27, 2015 entitled "Synthesis of superposition shape images by light interacting with layers of lenslets" inventors Hersch, Walger, Besson, Flauraud, Brugger (different categories of moirés, all in transmission mode), herein incorporated by reference;

Please consider also the following references from the scientific literature, with present inventor Hersch also being one of the authors:

T. Walger; T. Besson; V. Flauraud; R. D. Hersch; J. Brugger, "1D moiré shapes by superposed layers of microlenses", Optics Express. 23 of Dec. 2019, Vol. 27, num. 26, p. 37419-37434, hereinafter incorporated by reference, and cited as [Walger et al. 2019];

T. Walger; T. Besson; V. Flauraud; R. D. Hersch; J. Brugger, Level-line moirés by superposition of cylindrical microlens gratings, Journal of the Optical Society of America. 10 of Jan. 2020. Vol. A37, num. 2, p. 209-218, hereinafter incorporated by reference, and cited as [Walger et al. 2020].

R. D. Hersch and S. Chosson, Band Moiré Images, Proc. SIGGRAPH 2004, ACM Trans. on Graphics, Vol. 23, No. 3, 239-248 (2004), hereinafter referred to as [Hersch and Chosson 2004]

Other reference from the scientific literature:

H. Kamal, R. Völkel, J. Alda, Properties of the moiré magnifiers, Optical Engineering, Vol. 37, No. 11, pp. 3007-3014 (1998), referenced as [Kamal et al., 1998].

I. Amidror, The theory of the moiré phenomenon, Vol. 1, Section 4.4, pp. 96-108 (2009), referenced as [Amidror 2009].

S. Chosson, "Synthése d'images moiré" (in English: Synthesis of moiré images), EPFL Thesis 3434, 2006, pp. 111-112, referenced as [Chosson 2006].

E. Hecht, Optics, Chapter 5, published by Pearson, 2017, hereinafter cited as [Hecht 2017].

G. Oster, "Optical Art", Vol. 4, No. 11, 1965, pp 1359-1369, hereinafter referred to as [Oster 1965].

BACKGROUND OF THE INVENTION

It is known since a long time that synthesized moiré shapes can be used for aesthetical purposes, see U.S. Pat. No. 7,295,717 "Synthesis of superposition images for watches, valuable articles and publicity" to Hersch (also inventor in the present application), Chosson, Seri and Fehr and the publication written by [Oster 1965]. Until now moiré shapes have been created on planar surfaces, see the patents (a) to (g) referenced above. The goal of the present disclosure is to show how to create visually appealing moirés on curved surfaces, mainly for decoration purposes.

SUMMARY OF THE INVENTION

The present invention aims at creating aesthetically pleasing moiré shapes on curved surfaces. A curved surface capable of displaying a dynamically evolving moiré shape comprises on its superior surface a grating of sampling elements. A curved base layer of base bands is placed below the superior surface of sampling elements at a certain focal distance that is generally a function of the sampling element period. Sampling elements can be embodied by a grating of cylindrical lenses, a grating of spherical lenses, a grating of transparent lines on a dark background or a grating of tiny transparent holes on a dark background.

The distance between the curved sampling revealing layer and the curved base layer depends on the sampling period. In case of sampling by cylindrical or spherical lenses, this distance is smaller than the focal length of the lenses. In case of sampling by transparent lines or small transparent disks, the distance between the curved layers can be made equal to the sampling period for the 1D and 2D moiré and about half the sampling period for the level-line moiré. The curvature radius of the sampling lenses depends on the lens period which is in general equal to the lens width. The curvature radius should be larger than the lens width divided by $\sqrt{2}$.

In order to create a smooth moiré shape, it is advantageous to keep at the different locations of the curved surface a same angular field of view, defined by the ratio between the lens width and the lens curvature radius.

Let us describe the method for creating moiré shapes on a 3D curved surface formed by the superposition of a curved base layer and a curved revealing layer. The curved revealing layer comprises a grating of sampling elements embodied by cylindrical lenses, spherical lenses, transparent lines or transparent disks. The curved base layer comprises a grating of bands. In case of a level-line moiré, these bands are shifted according to an elevation profile, with the maximal shift being equal to half the base band repetition period. In case of a 1D moiré or a 2D moiré, these bands are composed of micro-shapes that are scaled-down and possibly deformed instances of the moiré shape. Let us describe the method for a revealer made of lenses. The steps are similar for revealers made of transparent lines or disks. For a revealer made of lenses, the method comprises the following steps:

creating the layout of the moiré incorporating said moiré shapes in a planar space;

defining the layout of the revealing layer in that planar space;

deriving from the layout of the planar moiré and the parameters of the planar revealing layer the layout of the base layer in that planar space;

defining a first mapping between the planar parametric space and the desired target 3D curved surface and applying that first mapping to the planar revealing layer in order to obtain the curved revealing layer laid out onto the desired 3D curved surface, computing within positions of the revealing layer the space between neighboring isoparametric lines and according to that space, defining the dimensions of the lenses and computing their corresponding nominal focal lengths;

positioning the lenses on top of the revealing layer surface according to their dimensions;

applying a second mapping consisting of mapping the planar base layer into the curved base layer by placing the base layer surface at focal distances from the curved revealing layer surface that are equal or smaller than the computed nominal focal lengths;

creating with the resulting curved base layer and curved revealing layer a mesh object that is ready for fabrication.

The resulting curved surface moiré has small lenses at locations where the distance between successive isoparametric curves is small and large lenses where this distance is large.

A curved surface moiré generated by the method described above comprises on its top the curved revealing layer with its sampling elements which for small objects are generally cylindrical lenses or spherical lenses and for larger objects transparent lines, transparent disks or holes. Upon change of orientation, the moiré shape evolves. In case of a level-line moiré, the moiré shape shows a beating behavior, where constant intensities move across successive level lines of the shown moiré shape or of its elevation profile. In case of a 1D moiré or 2D moiré, upon change of observation angle, the moiré shape displaces itself from one location to another location. A change of observation angle is obtained by tilting the curved moiré surface or when the observer moves and sees the curved moiré surface from another position. The shown moiré shape is a recognizable shape selected from the set of words, letters, numbers, flags, logos, graphic motifs, drawings, clip art, faces, houses, trees, and animals.

In order to produce a 3D curved surface showing a moiré shape, one needs an apparatus formed by a computing system. Such an apparatus comprises:

(i) a computer operable for executing software modules with a CPU, memory, disks and a network interface;

(ii) a software module for preparing in a planar parametric space within the computer memory a layout of the base and revealing layers from which the layouts of the curved base and revealing layer surfaces are derived;

(iii) a software module for specifying a first mapping between the planar parametric space and the desired target 3D curved surface and for applying said first mapping to the planar revealing layer in order to obtain said curved revealing layer surface;

(iv) a software module which according to the space between neighboring isoparametric lines defines the dimensions of the lenses and computes their corresponding nominal focal lengths;

(v) a software module for positioning the lenses on top of the curved revealing layer surface according to their dimensions;

(vi) a software module for applying a second mapping of the planar base layer into the curved base layer by placing the base layer surface at distances from the curved revealing layer surface that are equal or less than the computed focal lengths;

(ix) a software module for creating with the resulting curved base layer and curved revealing layer a mesh object that is ready for fabrication.

In a preferred embodiment, the curved revealing grating of lenses is laid out along one set of isoparametric lines mapped onto the target curved surface. In addition, in order to ensure a constant angular field of view for lenses at different positions of the revealing layer, the ratio between lens width and lens curvature radius is kept constant.

The resulting produced mesh is formed by the object or attached to an object. Such objects comprise bottles, watches, bracelets, rings, brooches, necklaces, lampshades, fashion clothes, cars, lampshades and illumination devices. With the produced mesh the curved surface moiréis fabricated by one or several of the following technologies: 3D printing, CNC machining, electro-erosion, and injection molding.

The main advantages of the present invention are the following: dynamically evolving moiré shapes can be created on many different curved surfaces, mainly for decoration purposes. By just tilting the object incorporating the moiré surface, or by moving in front of that object, one can observe beating shapes, moving shapes, rotating shapes as well as shapes that change their size. Most of the planar moiré effects are to some extent reproducible on curved surfaces. However, in order to reproduce planar moiré effects on curved surfaces difficulties arise due to the fact that the mapping between the planar domain and the 3D curved surface domain does in general neither preserve distances nor angles. Therefore special techniques are needed for the correct mapping of revealing and base layers onto curved surfaces. These special techniques are also needed for selecting the dimensions of the sampling elements such as the width and the curvature radius of the lenses.

DETAILED DESCRIPTION OF THE INVENTION

The present disclosure presents methods for producing dynamically evolving moiré shapes on curved surfaces. Such curved surface moiré shapes contribute to the decoration of time pieces such as watches and their armbands. They also decorate jewelry such as bracelets, rings, necklaces, as well as daily used objects such as bottles and tea-cups. The curved surface moiré items incorporate a base layer and revealing layer, with the base layer incorporating in reflection mode partly absorbing and partly reflecting surface elements and with the corresponding revealing layer incorporating primarily 1D cylindrical or 2D spherical lens arrays whose task is to sample the base layer. In transmission mode, the base layer may incorporate absorbing and transmitting surface elements or light diffusing and light transmitting surface elements.

Figure 6:
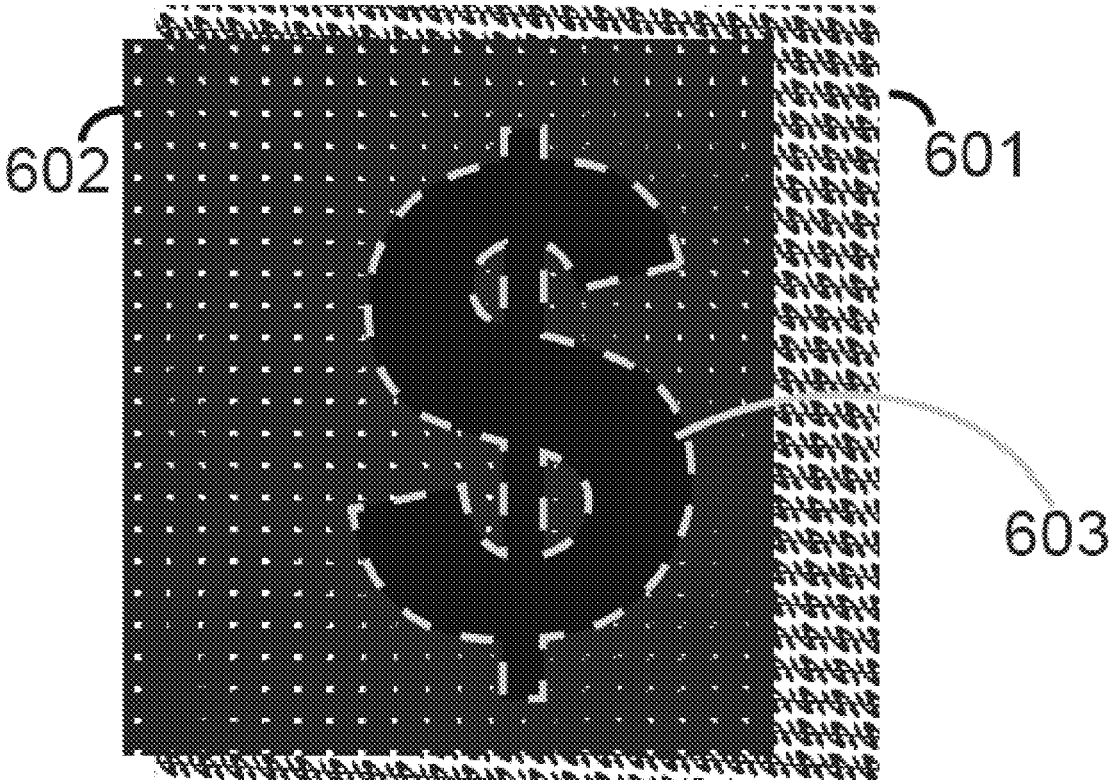
FIG. 6 shows the components of a 2D moiré, with the base 601 formed by bands having each an array of "$" micro-shapes 602, with the revealer formed by an array of tiny transparent disks and by the superposition of base and revealer yielding as moiré the large "$" shape.

The considered moirés are the 1D moiré, the level-line moirés, and the 2D moirés. For a thorough introduction, see U.S. Pat. No. 10,286,716. Each moiré technique has its own mathematical basis relating the layout of the moiré shape, the layout of the revealing layer grating and the layout of the base layer grating. Layouts of rectilinear moirés are defined by their shapes and by their parameters, especially the revealing layer repetition period(s) and orientation(s) and the base layer repetition vector(s) and orientation(s). Depending on the considered moiré type, the revealing layer is either formed of a 1D grating of cylindrical lenses or by a 2D grating of spherical lenses. The base layer comprises foreground and background shapes derived from the foreground and background of the moiré shape. For example, in case of a 1D moiré (FIG. 1A, FIG. 2A) or of a 2D moiré (FIG. 6), the base layer shape is a transformation of the moiré shape obtained by superposing base and revealer. In the case of the 1D moiré shown in FIG. 1A and of the 2D moiré shown in FIG. 6, the transformation is linear.

Definitions and Vocabulary

Figure 11A:
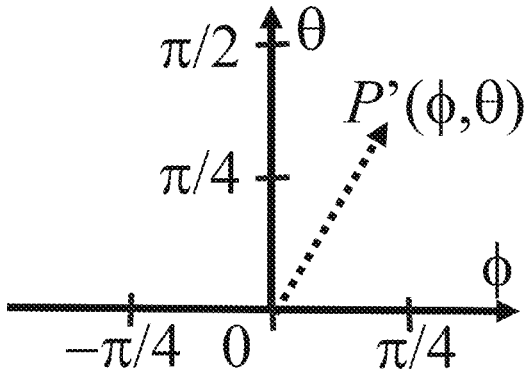
FIG. 11A show in the planar parametric space $(\phi,\theta)$ the position of a point P'.
Figure 11B:
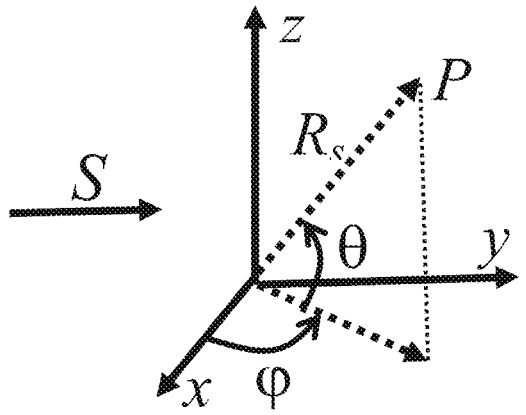
FIG. 11B shows the corresponding point P in the 3D space, at the position defined by the azimuthal angle $\phi$ and the ordinate angle $\theta$.

In the (u,v) plane, the term "ordinate line" is used for specifying a line parallel to the u axis. In the (ϕ,θ) plane (FIG. 11A) or in the (ϕ,θ) sphere (FIG. 11B) the term "ordinate line" designates an isoperimetric line with a constant value of θ. The term abscissa line designates an isoperimetric line having a constant azimuthal value ϕ.

Figure 1A:
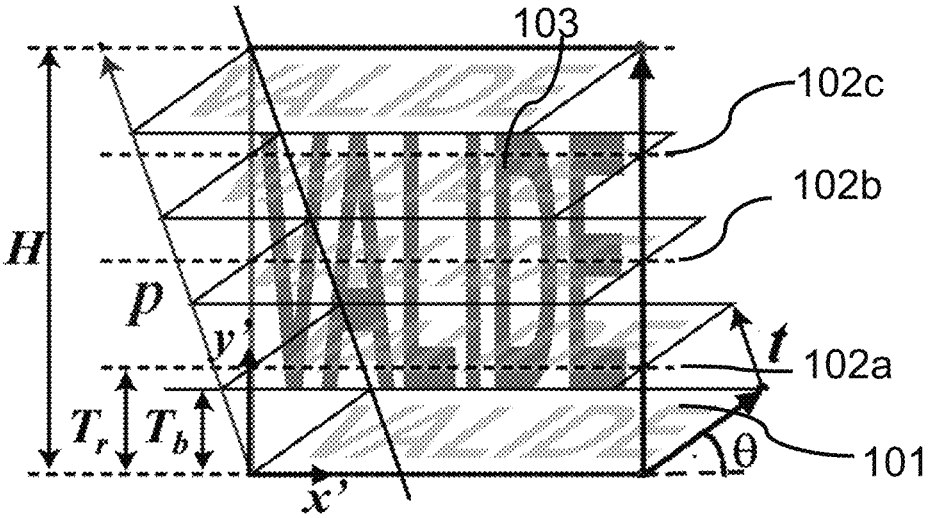
FIG. 1A shows a 1D moiré 103 formed by the superposition of a base layer made of base bands 101 incorporating micro-shapes and of a revealing layer comprising sampling lines 102*a*, 102*b*, 102*c;*
Figure 2A:
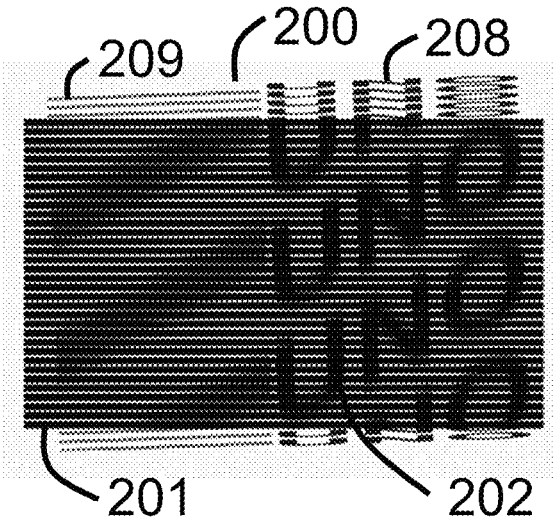
FIG. 2A shows a rectilinear 1D moiré where most elements a rectilinear.

For the sake of simplicity, let us call the base layer simply "base", the revealing layer simply "revealer" and the moiré layer simply "moiré". In FIG. 1A the parallelograms 101 form the base, the dashed lines 102*a*, 102*b*, 102*c* represent sampling lines forming the revealer and the large "VALIDE" shape 103 is the moiré.

Figure 2B:
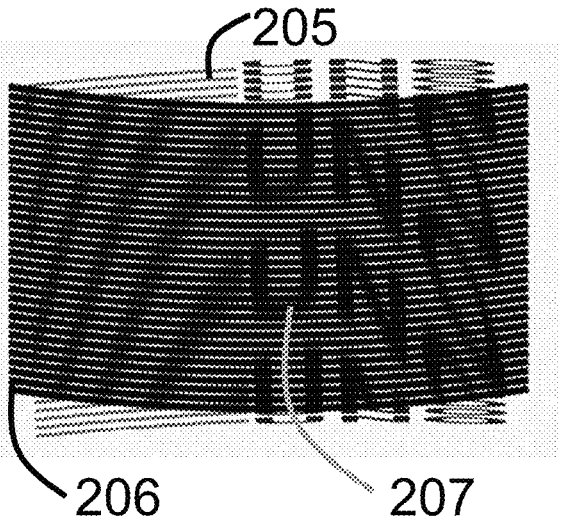
FIG. 2B shows a curvilinear 1D moiré where most elements a curvilinear.
Figure 10:
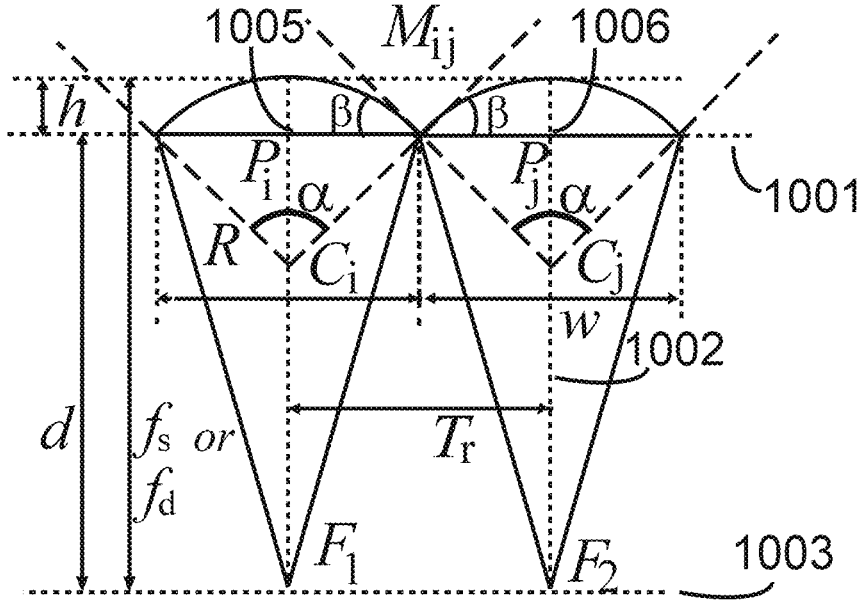
FIG. 10 shows the sections of two lenses from an array of lenses, with the angular field of view $\alpha$, the lens tangent angle $\beta$ and the focal distance $f_d$.

The "revealer surface" is the surface (FIG. 10, 1001) on which the cylindrical or spherical lenses are placed. The "base surface" (FIG. 10 1003, FIG. 7, 706) is the surface located beneath the revealer surface that is sampled by the lenses of the revealer surface. The revealer surface is also called "lens supporting surface". Together with its lenses it forms the revealing layer or "revealer". The base surface with its micro-shapes (FIG. 2, 208) located within bands (208, 209) is also called "base layer", "base", "base band layer", "base band grating" and its bands are called "base layer bands".

The lenses of the revealer sample positions on the base surface. The "revealer to base distance" between the revealer lens supporting surface and the base layer surface should be equal or smaller than the focal length of the considered lens minus the sag-height of that lens. The space between revealer and base surfaces contains generally the same substrate material as the lens itself. The substrate thickness is made equal to the distance between revealer and base surfaces.

The term "moiré", "moiré shape" or "recognizable moiré shape" refers in the present invention to elements that are recognizable by a human being, such as a text, a word, a few letters, a number, a flag, a logo, a graphic motif, a drawing, a clip art item, a face, a house, a tree, an animal, or items recognizable by a computing device such as a 1D or 2D barcode.

In 1D and 2D moirés, the micro-shapes present in the base layer are derived by a transformation from the moiré shape. Micro-shapes are therefore formed by scaled down and possibly deformed shapes that resemble the recognizable moiré shapes (letters, numbers, symbols, graphical elements, etc.).

Geometric Transformations, Base Band Shifts and Planar to Curved Surface Mapping The present disclosure deals with a number of different geometric and parametric transformations from one domain into a second domain. We distinguish between rectilinear base (FIG. 2A, 200), rectilinear revealer 201, rectilinear moiré 202 and curvilinear base (FIG. 2B, 205), curvilinear revealer 206, and curvilinear moiré 207.

Figure 3:
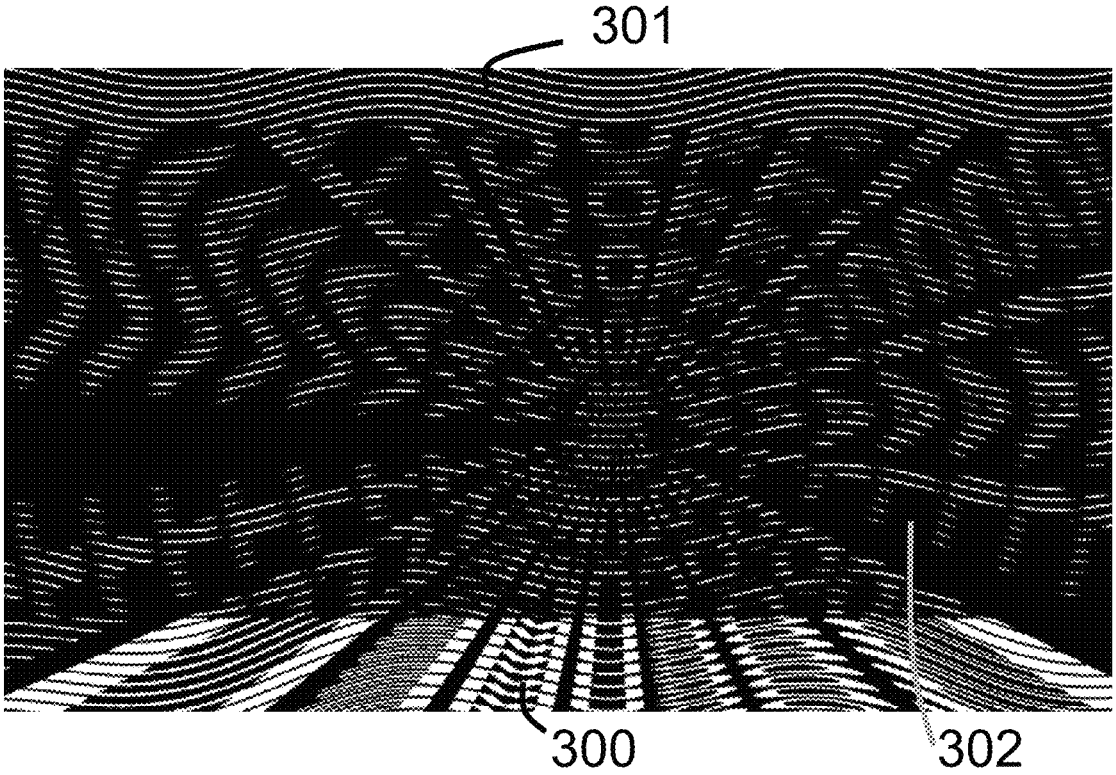
FIG. 3 shows a geometrically transformed moiré where the revealing layer 301 is geometrically transformed to become a cosinus function and where the base layer is also geometrically transformed to yield as superposition a circularly laid-out moiré shape 302 displacing itself radially.

Let us introduce first the geometric transformation from original planar space to the transformed planar space. In the original planar space the base, revealer and moiré comprise rectilinear line segments. In the transformed planar space, they often comprise curvilinear parts. FIG. 3 shows another example of a geometrically transformed base 300, revealer 301 and moiré 302 comprising curvilinear elements.

Giving the geometric transformation mapping from a transformed shape to an original rectilinear shape defines the layout of the transformed shape. Therefore, the geometric transformation equations are also called "layout equations".

In case of a level-line moiré, the base bands of the base layer are shifted according to elevations of the elevation profile. By shifting the base bands one obtains a new "layout" of the base layer. Therefore, in case of a level-line moiré, computing the layout of the base layer means shifting the base bands.

The base, revealing and moiré layers can be described either by pixmap images or by meshes made of vertices forming quads or triangles. In case of layers described by pixmap images, the (x,y), (u,v), (ϕ,θ) or (x,y,z) coordinates refer to pixel coordinates. In case of layers described by mesh vertices, these (x,y), (u,v), (ϕ,θ) or (x,y,z) coordinates refer to mesh vertex coordinates.

A) Transformation from the rectilinear planar base layer space to the rectilinear planar moiré space There is a linear transformation between the base layer space coordinates (x',y') (FIG. 1, 101) and the moiré space coordinates (x,y) 103. To create the base layer by computer means, we traverse the base layer space pixel by pixel, find the intensity or color of the corresponding moiré location and set that intensity or color to the considered base pixel. We define:

Base to moiré transformation L: $(x,y)=L(x',y')$.

B) Transformation from a rectilinear 2D space to a geometrically transformed 2D space Often the geometrically transformed base, revealer or moiré layers are obtained by applying a back-transformation from transformed space $(x_t, y_t)$ to original space (x,y). However, if one needs the inverse transformation, for example for mapping mesh vertices from the original space to the target space, one can inverse that geometric transformation, either analytically, or by performing with a computing module an optimization such as gradient descent. We define:

For the base: Transformation H: $(x,y)=H(x_t, y_t)$;

For the revealer: Transformation G: $(x,y)=G(x_t, y_t)$;

For the moiré: Transformation M: $(x,y)=M(x_t, y_t)$.

C) First mapping from a planar 2D surface to a curved 3D surface

The creation of moiré on a curved surface is based on the parametric description of the curved surface, which can be understood as a transformation from a 2D planar surface to a 3D curved surface. In formal terms:

Mapping S from a 2D planar to a 3D curved surface: (x,y,z)=S(u,v).

Instead of parameter values (u,v), angular parameters are often used: (ϕ,θ).

Overview of the Processing Steps to Create a Moiré on a Curved Surface

Figure 4:
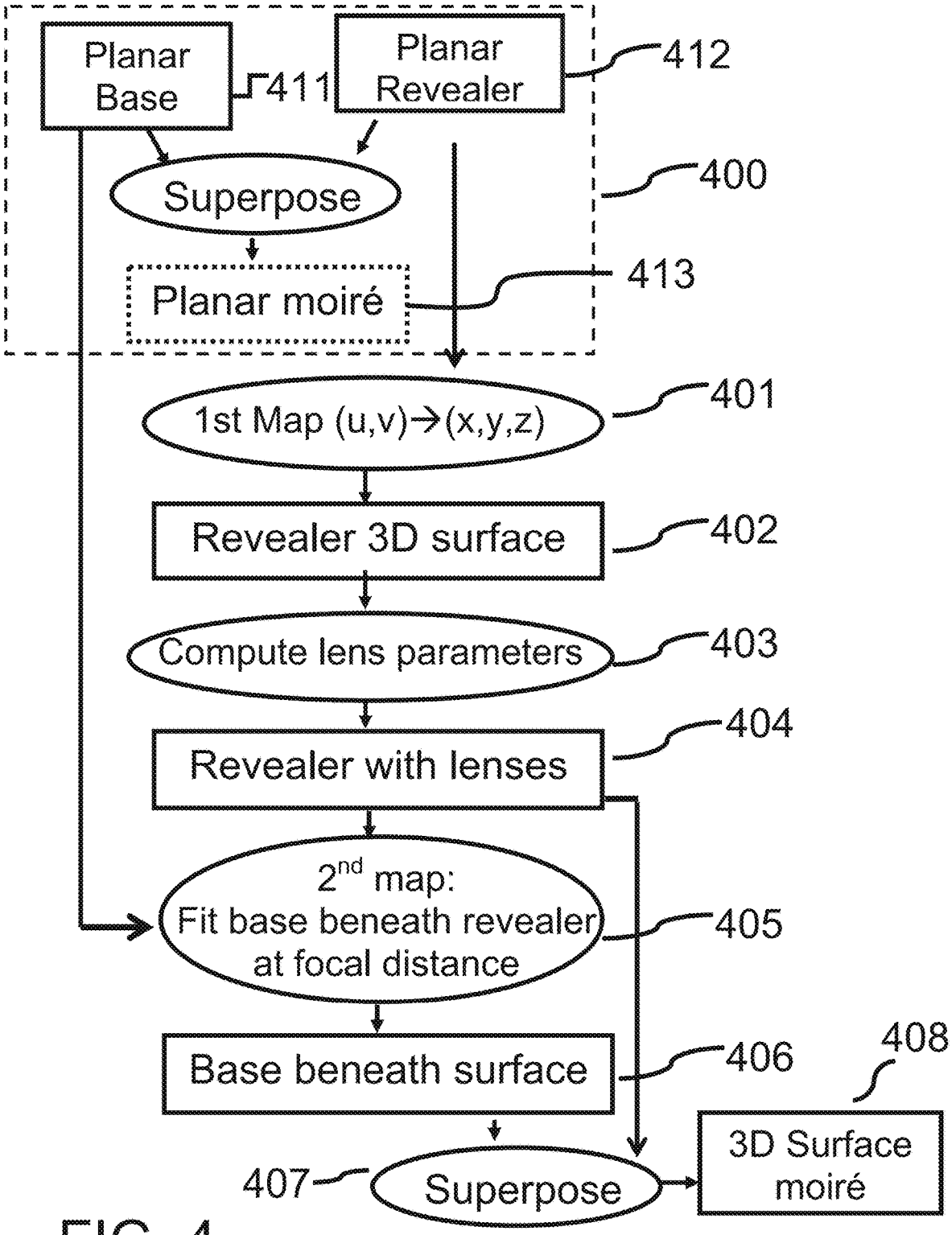
FIG. 4 shows a flow-chart of the operations carried out to obtain a 3D curved surface moiré 408.

For the creation of a planar moiré (FIG. 4, 400), one starts with a desired moiré shape 413 defined in the moiré coordinate space and computes for given revealing layer parameters 412 the layout of the base layer 411.

In order to obtain a moiré on a curved surface 408, one starts by creating the layout of the base 411 and revealer 412 so as to obtain first a desired planar moiré shape 413. This desired planar moiré shape can be a curvilinear geometrically transformed moiré shape such as the one shown in FIG. 3, where the moiré "VALID OFFICIAL DOCUMENT" is laid our circularly and moves radially upon displacement of the revealer, from the center to the exterior of the moiré space. The mathematical relationship between geometrically transformed moiré 302, revealer 301 and base 300 enables obtaining the base layer layout (FIG. 4, 411) as a function of the desired moiré 413 for given revealer layout parameters 412 specified by the designer.

These computed planar base and revealer layouts yielding the desired planar moiré are then placed within the planar (u,v) or (ϕ,θ) parameter space. This creates a direct correspondence between the base layer and revealing layer coordinates and the parameter space. The mapping S (401) from the planar parameter space to the 3D surface creates the curved revealer surface 402. Then the cylindrical or spherical lens parameters 403 are calculated and the corresponding lenses 404 are laid out along the isoparametric lines of the 3D surface. From the layout of the lenses, one can then compute the locations through which the base layer must pass 405. This yields the base layer well positioned 406 below the curved 3D revealer surface 406. Creating a fixed setup with the superposed curved base layer 406 and the curved revealer lens layer 404 yields the moiré that is displayed along the curved 3D surface 408.

Short Description of the 1D Rectilinear Moiré

Figure 1B:
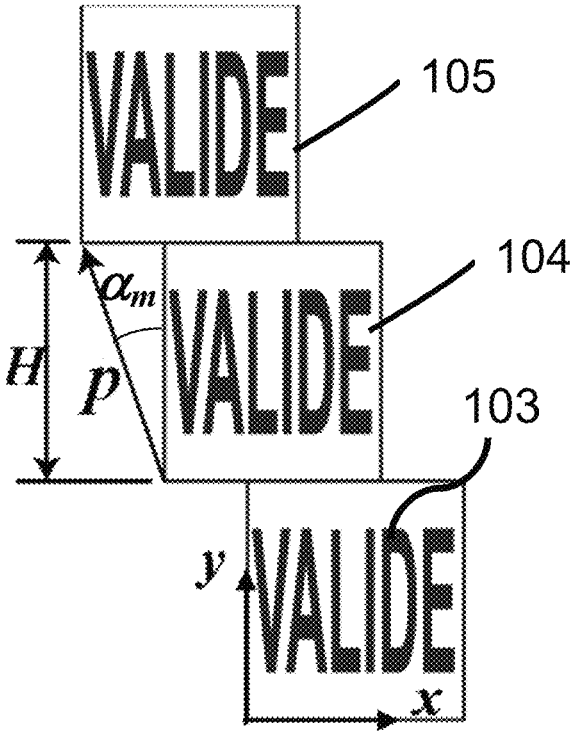
FIG. 1B shows the same 1D moiré travelling from the bottom location 103 to the intermediate location 104 and to the top location 105.

A thorough description of the 1D moiré is given in U.S. Pat. No. 10,286,716. For the planar moiré case, FIGS. 1A and 1B show the relationship between base coordinates and moiré coordinates for a rectilinear moiré, i.e. a moiré defined as a linear transformation of the replicated base bands. Base band 101 of base band period $T_b$ with oblique base band micro letter shapes "VALIDE" is replicated by integer multiples of vector $t=(t_x, t_y)$ across the base layer to form the base band grating. The corresponding moiré shapes 103 "VALIDE" are obtained by the revealing layer sampling lines 102*a*, 102*b*, 102*c*, . . . having period $T_r$ sampling the base bands successively at different locations. The vertical component $t_y$ of base band replication vector t is equal to the base band period, i.e. $t_y=T_b$. According to [Hersch and Chosson 2004], the moiré space coordinate (x,y) in function of the base space coordinates (x',y') is:

$$\begin{bmatrix} x \\ y \end{bmatrix} = \begin{bmatrix} 1 & \frac{t_x}{T_r - T_b} \\ 0 & \frac{T_r}{T_r - T_b} \end{bmatrix} \begin{bmatrix} x' \\ y' \end{bmatrix} \tag{1}$$

where $T_r$ is the sampling line period.

Equation (1) expresses with its matrix the linear relationship L between planar base space coordinates (x',y') and planar moiré space coordinates (x,y).

By inserting the components $t_x$, $t_y$ of base band replication vector t as (x',y') into Eq. (1), and equating $t_y=T_b$, one obtains the moiré replication vector $p=(p_x, p_y)$. This calculation shows that the moiré replication vector p is the base band replication vector t multiplied by $T_r/(T_r-T_b)$. The moiré height $H_M$ is equal to the vertical component $p_y$ of the moiré replication vector p, i.e. $H_M=p_y$. Therefore, $$H_M = \frac{T_r \cdot T_b}{T_r - T_b} \tag{2}$$

A designer can freely choose his moiré image height $H_M$ and the direction of its movement $\alpha_m$ by defining replication vector $p=(p_x, p_y)$, with $p_y=H_M$ and $p_x=-H_M \tan \alpha_m$ and solve Eq. (1) for t using also Eq. (2). This yields the base band replication vector $$t=p(T_b/H_M) \tag{3}$$

After selecting a suitable value for the revealing layer period $T_r$, an imaging software module can then linearly transform a moiré image defined in the moiré coordinate space (x,y) into a base band defined in the base layer coordinate space (x',y') by applying the inverse of Eq. (1), i.e.

$$\begin{bmatrix} x' \\ y' \end{bmatrix} = \begin{Bmatrix} 0 & \frac{T_r - T_b}{T_r} \\ 1 & -\frac{t_x}{T_r} \end{Bmatrix} \begin{bmatrix} x \\ y \end{bmatrix} \tag{4}$$

Short Description of the 1D Curvilinear Geometrically Transformed Moiré

One may specify the layout of a desired curvilinear 1D moiré shape as well as the rectilinear or curvilinear layout of the revealing layer. Then, with the 1D moiré layout equations, it is possible to compute the layout of the base layer.

The layout of the 1D moiré image in the transformed space $(x_t,y_t)$ is expressed by a geometric transformation $M(x_t,y_t)$ which maps the transformed moiré space locations $(x_t,y_t)$ back to original moiré space locations (x,y). The layout of the revealing line grating in the transformed space is expressed by a geometric transformation $G(x_t,y_t)$ which maps the transformed revealing layer space locations $(x_t,y_t)$ back into the original revealing layer space locations (x',y'). The layout of the base grating in the transformed space is expressed by a geometric transformation $H(x_t,y_t)$ which maps the transformed base band grating locations $(x_t,y_t)$ back into the original base band grating locations (x',y'). Transformation $H(x_t,y_t)$ is a function of the transformations $M(x_t,y_t)$ and $G(x_t,y_t)$.

Let us define the geometric transformations M, G, and H as $M(x_t,y_t)=(m_x(x_t,y_t, m_y(x_t,y_t))$, $G(x_t,y_t)=(x, g_y(x_t,y_t)$, and $H(x_t,y_t)=(h_x(x_t,y_t), h_y(x_t,y_t))$. According to [Hersch and Chosson 2004], the transformation of the moiré $M(x_t,y_t)$ is the following function of the transformations of the base layer $H(x_t,y_t)$ and of the revealing layer $G(x_t,y_t)$:

$$x = m_x(x_t, y_t) = h_x(x_t, y_t) + (h_y(x_t, y_t) - g_y(x_t, y_t)) \cdot \frac{t_x}{T_r - t_y} \quad (5)$$

$$y = m_y(x_t, y_t) = h_y(x_t, y_t) \cdot \frac{T_r}{T_r - t_y} - g_y(x_t, y_t) \cdot \frac{t_y}{T_r - t_y}$$

where $T_r$ is the period of the revealing line grating in the original space and where $(t_x, t_y)=(t_x, T_b)$ is the base band replication vector in the original space.

Then base layer transformation $H(x_t,y_t)$ is deduced from Eq. (5) as follows when given the moiré layer transformation $M(x_t,y_t)$ and the revealing layer transformation $G(x_t,y_t)$ $$h_x(x_t, y_t) = (g_y(x_t, y_t) - m_y(x_t, y_t)) \cdot \frac{t_x}{T_r} + m_x(x_t, y_t) \quad (6)$$

$$h_y(x_t, y_t) = g_y(x_t, y_t) \cdot \frac{T_b}{T_r} + m_y(x_t, y_t) \cdot \frac{T_r - T_b}{T_r}$$

Therefore, given the moiré layout and the revealing layer layout, one obtains the backward transformation allowing computing the base layer layout. The moiré having the desired layout is then obtained by the superposition of the base and revealing layers.

FIG. 3 shows an example of a circularly laid out moiré 302 resulting from the superposition of a geometrically transformed revealer 301 and geometrically transformed base 300. The desired reference circular moiré image layout 302 is given by the transformation mapping from transformed moiré space back into the original moiré space, i.e.

$$m_x(x_t, y_t) = \frac{\pi - \text{atan}(y_t - c_y, x_t - c_x)}{2\pi} w_x \quad (7)$$

$$m_y(x_t, y_t) = c_m \sqrt{(x_t - c_x)^2 + (y_t - c_x)^2}$$

where constant $c_m$ expresses a scaling factor, constants $c_x$ and $c_y$ give the center of the circular moiré image layout in the transformed moiré space, $w_x$ expresses the width of the original rectilinear reference band moiré image and function atan(y, x) returns the angle $\alpha$ of a radial line of slope y/x, with the returned angle $\alpha$ in the range $(-\pi<=\alpha<=\pi)$. The curvilinear revealing layer is a cosinusoidal layer whose layout is obtained from a rectilinear revealing layer by a cosinusoidal transformation $$g_y(x_n,y_t)=y_t+c_1 \cos(2\pi x_t/c_2) \quad (8)$$

where constants $C_1$ and $c_2$ give respectively the amplitude and period of the cosinusoidal transformation. The corresponding cosinusoidal revealing layer is shown in FIG. 3, 301. By inserting the curvilinear moiré image layout equations (7) and the curvilinear revealing layer layout equation (8) into the 1D moiré layout model equations (6), one obtains the deduced curvilinear base layer layout equations $$h_x(x_t, x_t) = \left(y_t + c_1 \cos\left(\frac{2\pi x_t}{c_2}\right) - c_m \sqrt{(x_t - c_x)^2 + (y_t - c_y)^2}\right) \cdot \frac{t_x}{T_r} + \frac{\pi - \text{atan}(y_t - c_y, x_t - c_x)}{2 \cdot \pi} \cdot w_x \quad (9)$$

$$h_y(x_t, x_t) = c_m \sqrt{(x_t - c_x)^2 + (y_t - c_y)^2} \cdot \frac{T_r - t_y}{T_r} + \left(y_t + c_1 \cos\left(\frac{2\pi x_t}{c_2}\right)\right) \cdot \frac{t_y}{T_r}$$

These curvilinear base layer layout equations express the geometric transformation from the transformed base layer space to the original base layer space. The corresponding curvilinear base layer is show in FIG. 3, 300.

Short Description of the Level-Line Moiré

Figure 5A:
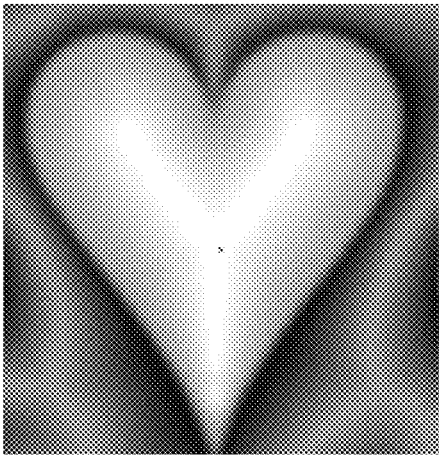
FIG. 5A show an elevation profile.
Figure 5B:
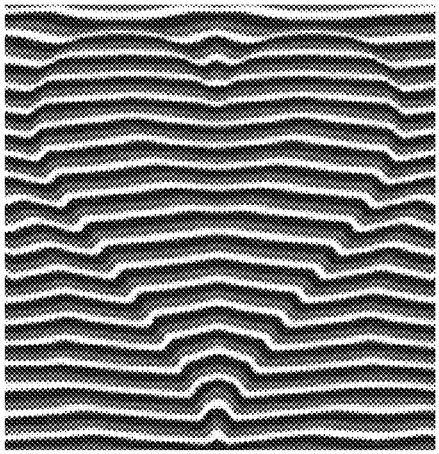
FIG. 5B shows a base layer formed by a grating of bands vertically shifted according to the elevation present in the elevation profile of FIG. 5A.
Figure 5C:
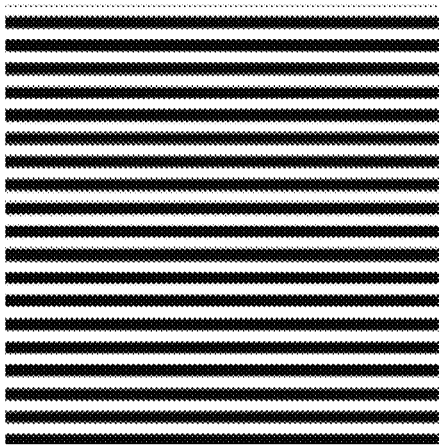
FIG. 5C shows a revealing layer made of transparent lines.
Figure 5D:
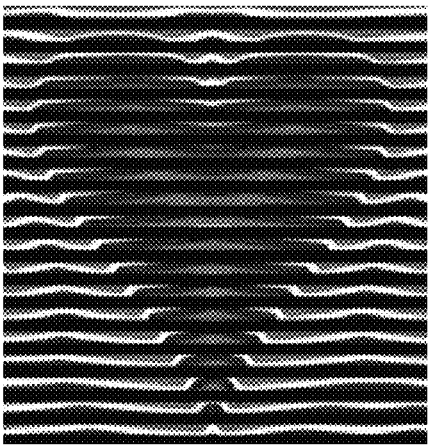
FIG. 5D shows a superposition of the base layer of FIG. 5B and the revealing layer of FIG. 5C.
Figure 5E:
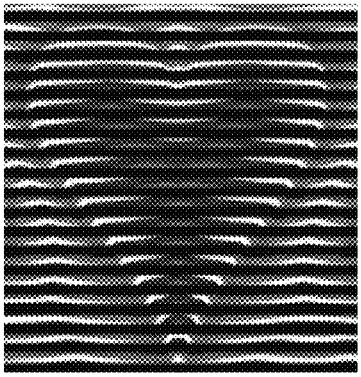
FIGS. 5E, 5F, and 5G show the same superposition as in FIG. 5D, but by displacing slightly the revealing layer on top of the base layer, thereby showing the beating effect produced by constant intensity lines travelling across successive level-lines of the moiré.
Figure 5F:
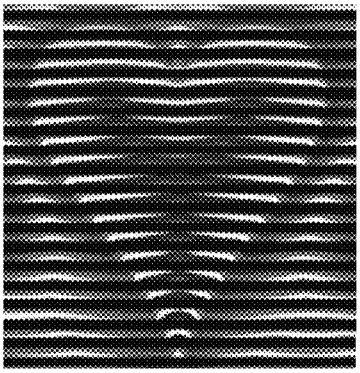
Figure 5G:
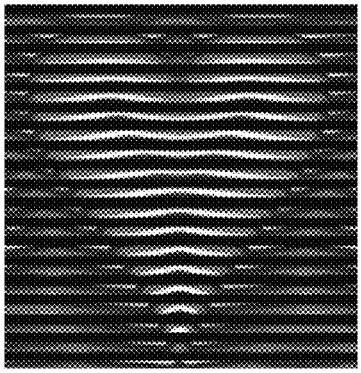

Level-line moiré are a particular subset of moiré fringes, where both the revealing layer grating and the base layer grating have the same period, i.e. $T=T_r=T_b$. Level line moirés enable visualizing the level lines of an elevation profile function E(x,y). For example, by superposing a base layer grating whose horizontal bands are vertically shifted according to the elevation profile function E(x,y) and a horizontal revealing layer grating having the same line period as the base layer grating, one obtains a level-line moiré. FIG. 5A shows an elevation profile, FIG. 5B shows the corresponding base layer with the shifted grating of lines, FIG. 5C shows a transparent line sampling grating as revealer and FIG. 5D shows the moiré obtained as superposition of the base layer shown in FIG. 5B and the revealing layer shown in FIG. 5C. By moving the revealer vertically on top of the base, different base positions are sampled and yield as shown in FIGS. 5D, 5E 5F and 5G a beating effect. Successive intensity levels are displayed at the level lines (constant intensity lines) of the elevation profile shown in FIG. 5A and also of the moiré shown for example in FIG. 5D, after applying a blurring operation.

In the present example, the transparent line grating (FIG. 5C) of the revealing layer samples the underlying base layer (FIG. 5B). However, in most real-world embodiments, instead of a transparent line grating, an array of cylindrical lenses is used for sampling the base layer incorporating the grating of bands that are shifted perpendicularly according to the elevation profile.

Short Description of the 2D Moirés

The theory regarding the analysis and synthesis of 2D moiré images is known, see the publications by [Kamal et al 1998] and by [Amidror 2009]. The 2D moirés are formed by a base layer incorporating a 2D array of letters, symbols or graphical elements superposed with a 2D array of sampling elements forming the revealing layer. The sampling elements of the revealing layer can be embodied by a 2D array of transparent disks or by a 2D array of spherical lenses. For example, in FIG. 6, 601, the "$" symbols form the 2D base layer array and the 2D array of transparent tiny disks 602 forms the revealing layer. The tiny transparent disks of the revealing layer sample the underlying base layer elements and reveal the moiré, in the present case an enlarged and rotated instance of the "$" tiny shape 603.

In most embodiments, instead of an array of tiny disks, an array (FIG. 7, 701) of spherical lenses (701, 702) forms the sampling layer that samples the base layer array 706 of elemental tiny shapes 704. This enables obtaining moirés with a much higher contrast. When viewed from the far position 708, for lens 701, light rays are reflected from location 707 along cone $f_1$, traverse the lens interface to the air 701 and reach the eye. In a similar manner, for lens 702, light rays are reflected from location 705 along cone $f_2$, traverse the lens interface to the air 702 and reach the eye. When viewed from the far position 709, for lens 701, light rays are reflected from location 710 along cone $f_3$, traverse the lens interface to the air 701 and reach the eye. In a similar manner, for lens 702, light rays are reflected from location 711 along cone $f_4$, traverse the lens interface to the air 702 and reach the eye.

Figure 7:
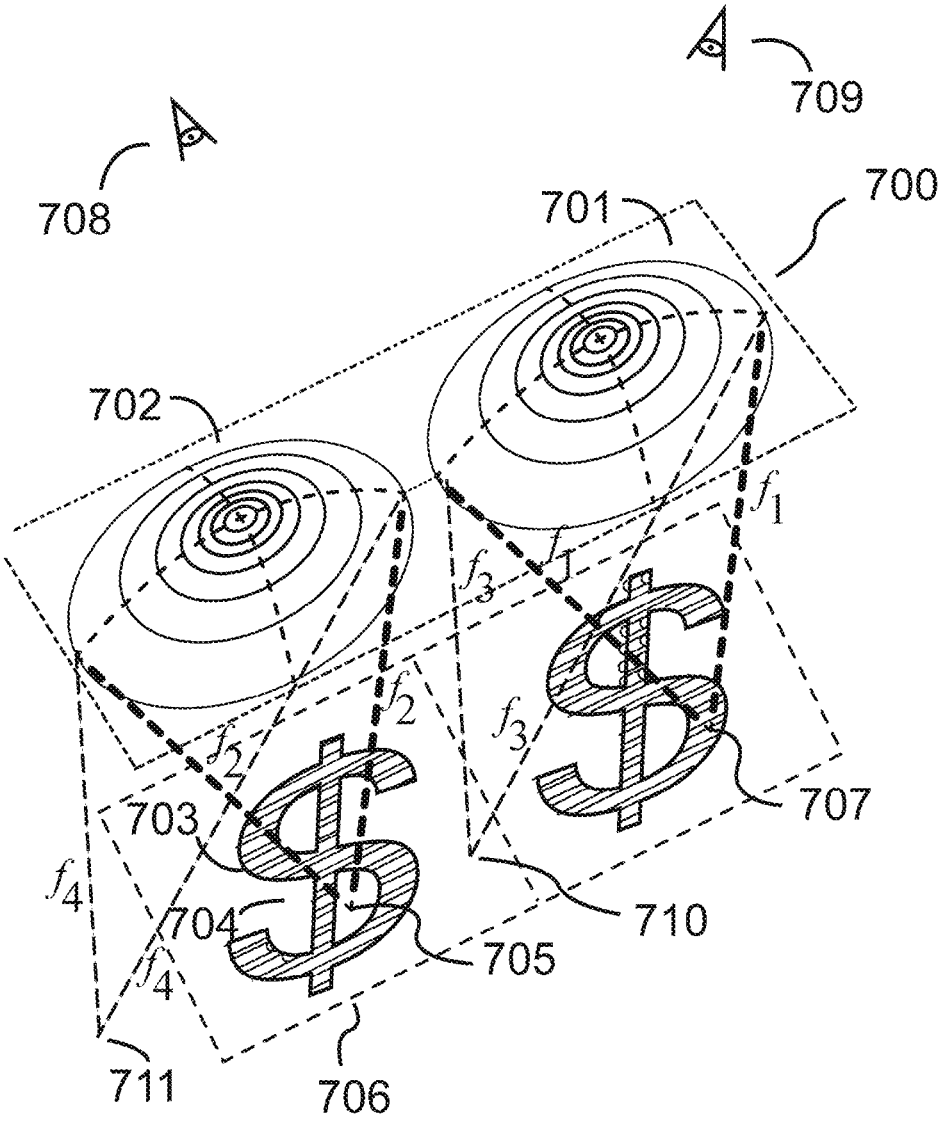
FIG. 7 shows a part of a base layer 706 with the "$" micro-shapes having a dark absorbing foreground 703 and a reflective or transmissive background 704, and a part of the revealer with two spherical lenses 702 and 701, focusing the incoming rays from the eye onto the base layer.

The example shown in FIG. 7 shows that viewed from observation position 708, different lenses sample different positions 707 and 705 within the repeated instances of the base layer elements. As shown also in FIG. 6, sampling different position within the base layer array of elements 601 creates the moiré 603. When moving the position of the eye from one location 708 to a second location 709, the positions sampled from the base layer are also changing, e.g. for the lens 701, from position 707 to position 710 or for lens 702 from position 710 to position 711. FIG. 7 also shows that the focal distance defined here as the distance between the lens top (marked by a small +) and the sampling point is different when the lens is viewed from a normal direction (e.g. 708) or from an oblique direction (e.g. 709). From an oblique viewing direction 709, the focal distance is longer compared with the focal distance obtained by viewing from a normal direction 708. This is the reason for using as nominal focal distance (FIG. 10, 1002) a value that is smaller than the focal length. Such a smaller focal distance induces a smaller substrate thickness and therefore a sharper moiré image at viewing angles oblique to the lens supporting revealer surface (see Section "Layout of the moiré on a curved surface").

To characterize the geometric layout of the 2D moiré shape as a function of the layouts of the base and revealing layers, we adopt the formulation of S. Chosson in his PhD thesis [Chosson 2006]. The layout of the 2D moiré image in the transformed space is expressed by a geometric transformation $M(x_t,y_t)$ which maps the transformed moiré space locations $(x_t,y_t)$ back to original moiré space locations (x,y). The layout of the 2D revealing array in the transformed space is expressed by a geometric transformation $G(x_t,y_t)$ which maps the transformed revealing array space locations $(x_t,y_t)$ back into the original revealing layer array space locations (x',y'). The layout of the 2D array of micro-shapes in the transformed space is expressed by a geometric transformation $H(x_t,y_t)$ which maps the transformed 2D micro-shape array locations $(x_t,y_t)$ back into the original 2D micro-shape array locations (x',y').

A desired rectilinear or curvilinear 2D moiré image layout is specified by its moiré height $H_y$ and width $H_x$ in the original coordinate space (x',y') and by its geometric transformation $M(x_t,y_t)$. A desired revealing layer layout of the 2D sampling array is specified by the period $T_{rx}$ along the x-coordinate and $T_{ry}$ along the y-coordinate of its elements in the original space (x',y') and by its geometric transformation $G(x_t,y_t)$. The base layer layout of the 2D array of micro-shapes is specified by the period $T_{bx}$ along the x-coordinate and $T_{by}$ along the y-coordinate of its elements in the original space (x',y') and by its calculated geometric transformation $H(x_t,y_t)$. Having specified the desired 2D moiré image layout, the layout of the 2D sampling revealing layer, and the size of the micro-shapes in the original space, then according to [Chosson 2006], the base layer geometric transformation $H(x_t,y_t)$ is obtained as function of the transformations $M(x_t,y_t)$ and $G(x_t,y_t)$.

Let us define the transformations M, G, and H as $M(x_t, y_t)=(m_x(x_t,y_t, m_y(x_t,y_t))$, $G(x_t,y_t)=(g_x(x_t,y_t), g_y(x_t,y_t)$, and $H(x_t,y_t)=(h_x(x_t,y_t, h_y(x_t,y_t))$. Then, according to [Chosson 2006] transformation $H(x_t,y_t)$ is obtained by computing $$\frac{h_x(x_t, y_t)}{T_{bx}} = \frac{m_x(x_t, y_t)}{H_x} + \frac{g_x(x_t, y_t)}{T_{rx}} \qquad (10)$$

$$\frac{h_y(x_t, y_t)}{T_{by}} = \frac{m_y(x_t, y_t)}{H_y} + \frac{g_y(x_t, y_t)}{T_{ry}}$$

In the present invention, the revealing layer is embodied by a 2D array of lenslets located on the lens supporting surface (FIG. 7, 700), shown schematically by two lenslets (701, 702) in FIG. 7 and the base layer by a 2D array of virtual micro-shapes shown schematically by two "$" signs 706. Note that this 2D array can also be conceived as a 1D array of bands, within which there is a repetition of the micro-shapes.

Figure 8A:
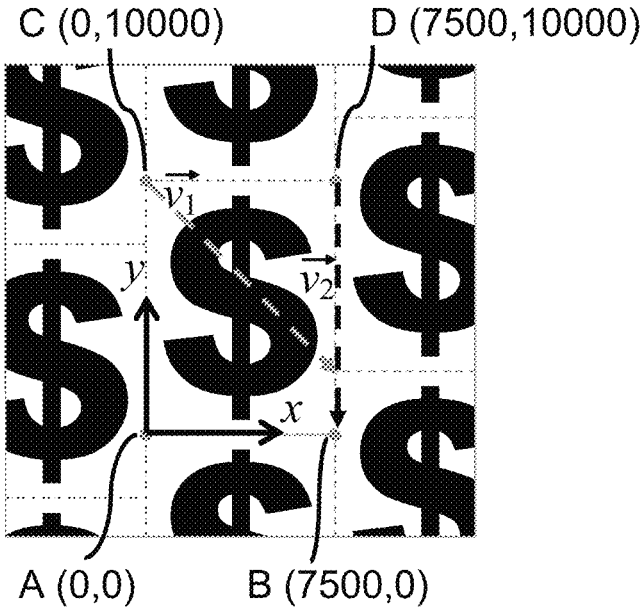
FIG. 8A shows the same moiré as in FIG. 6, with at the center the layout of the large "$" moiré shape with its tile rectangle being defined by the A, B, C, D vertices, and its replicates along the vertical and diagonal directions.
Figure 8B:
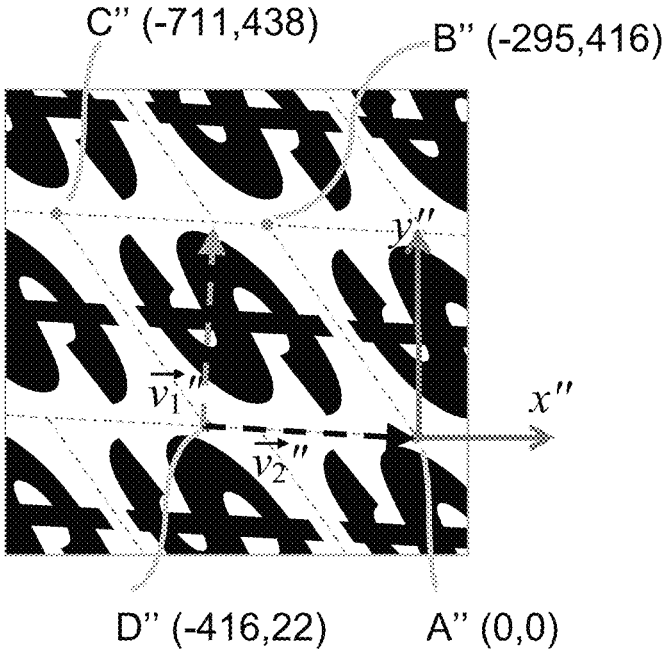
FIG. 8B shows the base corresponding to the moiré of FIG. 8A where moving the revealer on top of the base moves the moiré in the vertical or diagonal directions.

According to [Chosson 2006], for rectilinear moiré, the equation bringing moiré layer coordinates (x,y) into base layer coordinates (x", y") by an affine transformation is the following:

$$\begin{bmatrix} x'' \\ y'' \end{bmatrix} = \frac{1}{(T_{rx}+v_{2x})\cdot(T_{ry}+v_{1y}) - v_{1x}\cdot v_{2y}} \begin{bmatrix} T_{rx}\cdot(T_{ry}+v_{1y}) & -v_{1x}\cdot T_{rx} \\ -v_{2y}\cdot T_{ry} & T_{ry}\cdot(T_{rx}+v_{2x}) \end{bmatrix} \begin{bmatrix} x \\ y \end{bmatrix} \qquad (11)$$

where $\vec{v}_1=(v_{1x}, v_{1y})$ is defined as a first moiré replication vector and $\vec{v}_2=(v_{2x}, v_{2y})$ is defined as a second moiré replication vector and where $T_{rx}$ and $T_{ry}$ are the revealing layer horizontal and vertical periods. As an example, FIG. 8A gives the coordinates of the desired moiré layout. The desired moiré displacement vectors are $\vec{v}_1=(7500, -7500)$ and $\vec{v}_2=(0, -10000)$. Inserting the coordinates of the moiré vertices A, B, C, D shown in FIG. 8B as (x,y) into Equation (11) yields the coordinates of the corresponding base layer vertices A", B", C", D" shown in FIG. 8B. Therefore, for the two desired moiré displacement vectors, and for given revealing layer periods, one may calculate the base layer position x", y" corresponding to positions x, y in the moiré image. By inserting the moiré displacement vectors $\vec{v}_1$ and $\vec{v}_2$ into Eq. (11), one obtains the corresponding base tile replication vectors, $\vec{v}_1$" and $\vec{v}_2$" see FIG. 8B.

In order to obtain a base layer mesh of the microshapes, one creates the desired moiré shape similar to the central shape of FIG. 8A with its vertices defining the borders of the "$" shape. Then one applies Eq. (11) to obtain the corresponding vertices of the central micro-shape of FIG. 8B. The obtained micro-shape is then replicated with vectors $\vec{v}_1$" and $\vec{v}_2$".

Curvilinear moiré layouts described by a geometrical transformation $M(x_t,y_t)$ may be produced by further applying the transformation $H(x_t,y_t)$ described in Eq. (10) to the base layer array of micro-shapes.

Characterization of the Lenses Used as Revealing Layer Lens Arrays

Figure 9A:
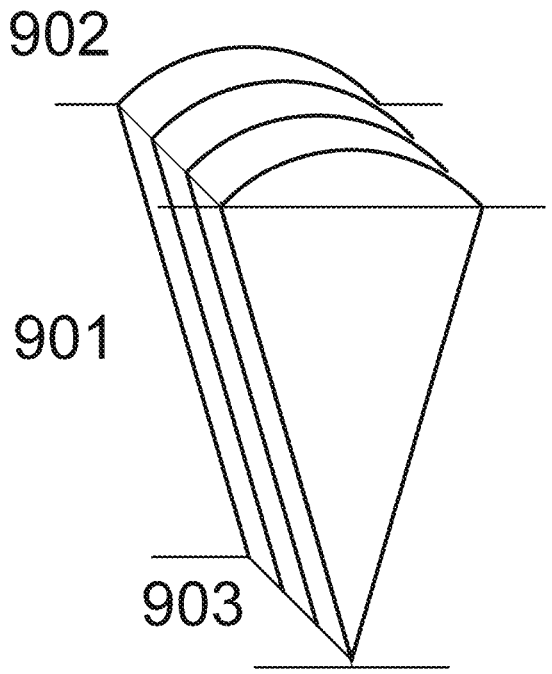
FIG. 9A shows a cylindrical lens 902 on top of a substrate 901 focusing the incoming rays onto a base layer 903.

The revealing layer lens array samples the underlying base layer arrays element. FIG. 9A shows a part of a cylindrical lens where the upper part 902 is the air, the center part 901 is the substrate medium in which the lens is formed, with its upper part interfacing with the air and its lower part interfacing with the base layer 903. On a planar base layer, the optimal distance between lens top and base layer is the nominal focal length (FIG. 9B, $f_s$) of the lens, see [Walger 2019] and [Walger 2020].

The parameters (FIG. 9B, FIG. 10) defining the revealing layer lenslets are the repetition period (pitch) $T_r$, the width of the cylindrical or spherical lenslet w, their sag-height h and their nominal focal length $f_s$ or their focal distance $f_d$.

Figure 9B:
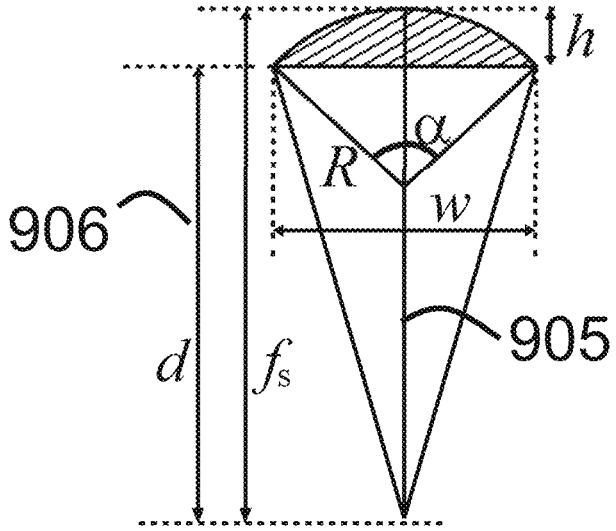
FIG. 9B shows a section through the cylindrical lens of FIG. 9A with the lens curvature radius R, the width w, the sag-height h, the angular field of view $\alpha$, the nominal focal length $f_s$ and the substrate thickness d.

These lens parameters can be calculated by considering a section of a generic cylindrical lenslet, see FIG. 9B.

We rely on the laws of geometrical optics as described by [Hecht 2017, Chapter 5]. Let us calculate the relations between the different lens parameters.

By relying on the geometry of FIG. 9B, we have $$(R-h)^2 = R^2 - \left(\frac{w}{2}\right)^2 \tag{12}$$

By developing (12) in order to express the lens curvature radius R as a function of the lens width w and the cap-height h, we obtain $$R = \frac{w^2}{8h} + \frac{h}{2} \tag{13}$$

According to [Hecht 2017, formula 5.10], the focal length is given by $$f_s = \frac{n_s}{n_s - n_{air}} \cdot R \tag{14}$$

Where $n_s$ and $n_{air}$ are the indices of refraction of the lens substrate and of the air, respectively. In case of a material having an index of refraction $n_s$=1.5, we obtain the simple relationship $f_s$=3 R, i.e. the focal length is three time the size of the lens curvature radius. In addition, according to FIG. 9B, the relation between focal length $f_s$ or focal distance $f_d$, substrate thickness d and sag-height h is $$h = f_s - d \text{ if } f_d = f_s$$

$$h = f_d - d \text{ else } f_d < f_s \tag{15}$$

Let us define the focal length reduction factor k:

$$k = \frac{f_d}{f_s} \tag{16}$$

From Equation (13) and also from the geometry of FIG. 6B, we can deduce the sag-height h as a function of lens curvature radius R and lens width w:

$$h = R - \sqrt{R^2 - \left(\frac{w}{2}\right)^2} \tag{17}$$

The sag-height h enables obtaining the center of the lens surface, useful for creating the mesh that is used for fabrication. Generally, we set the lens width w of revealer lenses according to the desired revealing layer lens repetition period $T_r$, i.e. w=$T_r$. The revealing layer lens repetition period depends on the size of the moiré and the size of the object on which the moiré will appear. For example on a moiré display size of 10 cm, the repetition period can be between 0.2 mm to 1.5 mm. On a piece of jewelry of limited size however, the moiré will appear within a region having a diameter between 3 mm and 10 mm. The lens repetition period will then be much smaller, e.g. between 0.05 mm and 0.2 mm.

For a planar moiré design, after fixing the lens repetition period and therefore also the lens width w=$T_r$, the lens curvature radius R needs to be selected. The lens curvature radius R defines the angular field of view α, see FIG. 10. The tangent to the lens at the lens junction point forms an angle β with the horizontal plane. As long as angle β is smaller than 45 degrees, the angular field of view is given by angle α. If angle β is larger than 45 degrees, then the effective angular field of view is less than angle α, because rays from the center $C_i$ of one lens that also cross the meeting point $M_{ij}$ of two neighbouring lenses $C_i$ and $C_j$ also intersect the neighbouring lens segment having its origin in $C_j$. Therefore, angle β should be smaller than 45 degrees and angle alpha smaller than 90 degrees. This yields a condition for the lens curvature radius R:

$$R \geq \left(\frac{w}{2}\right) \cdot \sqrt{2} \tag{18}$$

The larger the radius the flatter the circular section of the lens and the larger the focal length as well as the required thickness of the material. If condition (18) is fulfilled, one obtains for the angular field of view α:

$$\alpha = 2 \cdot \arcsin\left(\frac{w}{2R}\right) \tag{19}$$

Conceiving a revealing layer consists in defining the lens repetition period according to the desired type of moiré. Once the revealer lens repetition period $T_r$ is selected, the lens width w is derived, in general w=$T_r$. Then the lens curvature radius R is determined accounting for the constraint expressed by formula (18). From the lens curvature radius R, one derives the focal length $f_s$ according to Equation (15) and the sag-height h according to Equation (17). The substrate thickness d is defined according to Equation (15). The angular field of view α is obtained by Equation (19). For a moiré generated on a planar surface, the angular field of view α is constant. According to Eq. (19), keeping on the cylindrical or spherical lenses the ratio between lens width and lens curvature radius R constant enables, if inequality (18) is respected, to have for lenses at different positions of the revealing layer a constant angular field of view α.

Layout of the Moiré on a Curved Surface

Generating level-line moirés, 1D Moirés and 2D moirés on planar surfaces is known from the corresponding patents and thesis chapters:

Level line moirés: U.S. Pat. Nos. 7,305,105 and 10,286,716

1D moirés: U.S. Pat. Nos. 7,751,608, and 10,286,716

2D moirés: U.S. Pat. No. 6,819,775 and [Chosson 2006].

One way to define a curved surface consists in defining a mapping S between a planar reference surface given by its (u,v) or (θ,ϕ) coordinates and a surface located in the (x,y,z) 3D space. In the general case, with s being a vector function, we have $$S: \begin{pmatrix} x \\ y \\ z \end{pmatrix} = s(u, v) \tag{20}$$

As an example, we can describe a mapping of a portion of the parametric (ϕ,θ) plane (FIGS. 11A, 11B) into a portion of a hemisphere of radius $R_s$, ranging from azimuthal angle $\phi=-\frac{1}{4}\pi$ to azimuthal angle $\phi=+\frac{1}{4}\pi$. According to the geometry of FIG. 11B, the mapping formula s(θ,ϕ) is the following:

$$x = R_s \cdot \cos\theta \cdot \cos\phi \quad (21)$$
$$y = R_s \cdot \cos\theta \cdot \sin\phi$$
$$z = R_s \sin\theta$$

Figure 12A:
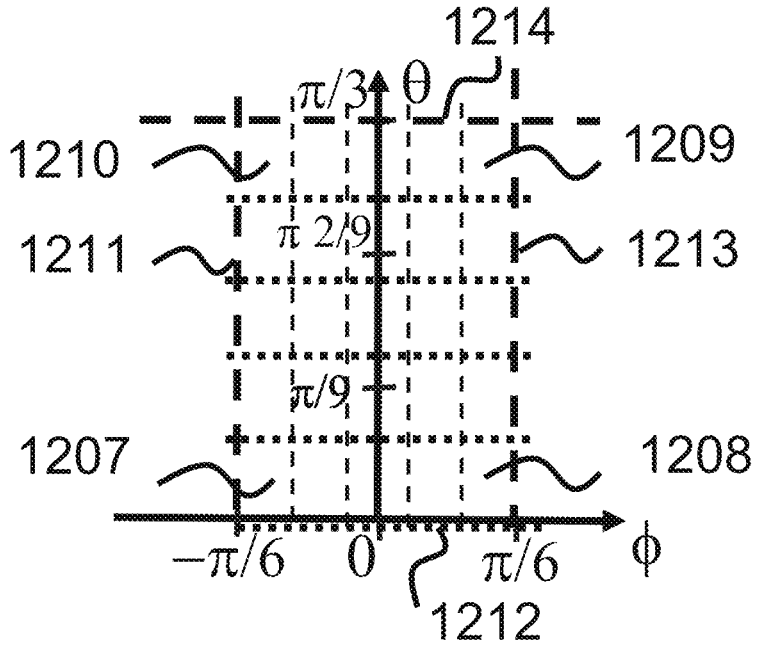
FIG. 12A shows a portion of the planar parametric $(\phi,\theta)$ space defined by its boundaries $-\pi/6 \leq \phi \leq +-\pi/6$ and $0 \leq \theta \leq +\pi/3$, expressed in radiant angular values.
Figure 12B:
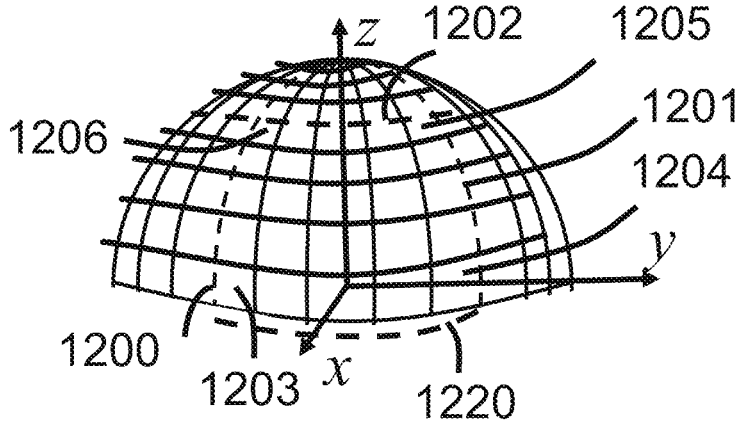
FIG. 12B shows the same portion as in FIG. 12A on the curved surface formed by a hemisphere, where the boundaries are defined by isoparametric lines 1200, 1220, 1201, 1202.

Another view of the same mapping between a portion of the planar parametric space (ϕ,θ) and a hemisphere is shown in FIGS. 12A and 12B, respectively. In these figures, we consider more specifically the region where $-\pi/6 \le \phi \le +\pi/6$ and where $0 \le 0 \le +\pi/3$. The left, bottom, right and top borders of that region are defined in FIG. 12A as 1211, 1212, 1213 and 1214. In FIG. 12B, they are defined by 1200, 1220, 1201 and 1202.

The mapping between the planar parametric space ϕ-θ and the hemisphere modifies the size of the mapped individual areas. For example, planar areas in FIG. 12A 1207, 1208, 1209 and 1210 are mapped into the hemispheric areas of FIG. 12B 1203, 1204, 1205 and 1206. Clearly, the individual areas of the considered portion of the hemisphere become smaller when coming closer to the north pole, i.e. to the value with $z=R_s$.

Let us first consider revealing layers for the level-line moiré and the 1D moiré. In both cases, the revealing layer is formed by an array of cylindrical lenses. We assume that in the planar parametric space, the cylindrical revealing layer lenses are laid out along isoparametric lines, i.e. lines with θ being constant. On the 3D surface, represented by the considered portion of the hemisphere, the corresponding cylindrical lenses are also laid out along isoparametric ordinate lines. Since in the case of a sphere the angular offset Δθ between the successive ordinate lines is constant, the width w of the cylindrical lenses (FIG. 10) also remains constant over the considered surface portion.

In the case of a 2D moiré, the revealing layer is made of a 2D array of spherical lenses (FIG. 7, 701, 702), laid out in the space between or on top of the intersections of isoparametric ordinate lines (FIG. 12A, horizontal lines) and isoparametric azimuthal lines (FIG. 12A, vertical lines). The corresponding areas are all the same in the planar parametric space. In the mapped spherical 3D space, the corresponding area is large close to the Equator (θ=0) and becomes thinner and thinner towards the north pole ($\theta \ge \pi/3$). There is less and less space for the revealing layer spherical lenses. Therefore, for the 2D moirés, the considered planar to spherical mapping is only adequate if one selects for the embodiment of a 2D moiré a limited portion of the hemisphere, such as the one proposed in FIG. 12B 1202, with $0 \le \theta \le \pi/3$.

Let us now consider the case of level-line and 1D moiré, where the revealing layer is made of a 1D array of cylindrical lenses (FIG. 9A, FIG. 24) and where the cylindrical lenses are laid out along isoparametric azimuthal values, i.e. at values of ϕ being constant. This corresponds to the vertical lines in FIG. 12A and to the curves connecting the Equator with the north pole, e.g. FIG. 12B, 1201. Although the angular space Δϕ between successive azimuthal values is constant, the space between the centers of the neighboring cylindrical lenses becomes narrower the closer we come to the north pole. This space defines the period $T_r(\theta)$ of neighboring cylindrical lenses at a given ordinate θ. With $w(\theta)=T_r(\theta)$, we can calculate the width w(θ) of the cylindrical lens as a function of the ordinate θ. With Equation (22), we calculate the distance $b_{01}$ between two points $P_0$ and $P_1$ located on the sphere of radius $R_s$, having the same ordinate θ and having an azimuthal difference Δϕ:

$$b_{01}(\theta) = 2 \cdot R_s \cdot \cos\theta \cdot \sin\left(\frac{\Delta\phi}{2}\right) \quad (22)$$

By calculating the width of the lenticular lens $w(\theta)=b_{01}(\theta)$, one can set at one of the lowest positions (e.g. θ=0) of the sphere portion the lens curvature radius R(θ=0) by (i) respecting inequality (18) and (ii) at the same time by setting a value for constant k which defines the ratio between focal distance $f_d$ and focal length $f_s$. Then it is possible to calculate the angular field of view according to Equation (19) and obtain for all other cylindrical lens positions the current lens width w(θ). $B_y$ keeping the angular field of view constant, one can calculate according to Equation (19) the corresponding lens curvature radius R(θ), and according to Equation (17) the sag-height h(θ). Finally, by deriving the focal length $f_s$ (θ) with Eq. (15) and by keeping k constant, one obtains the focal distance $f_d$ (θ) and with Eq. (15) the substrate thickness d(θ).

The parametric equation of the lens supporting surface therefore fully defines the layout and sizes of the cylindrical or spherical lenses that need to be present for synthesizing level-line, 1D or 2D moirés. The normal (FIG. 10, 1002) of each cylindrical lens segment through its center determines the nominal focal length $f_s$ given by Equation (15). The substrate thickness d(θ) is given by Equation (15). The substrate thickness d(θ) defines the distance between the lens supporting surface 1001 and the base layer surface 1003. On planar moirés, the substrate thickness is $d=f_s-h$.

Figure 13:
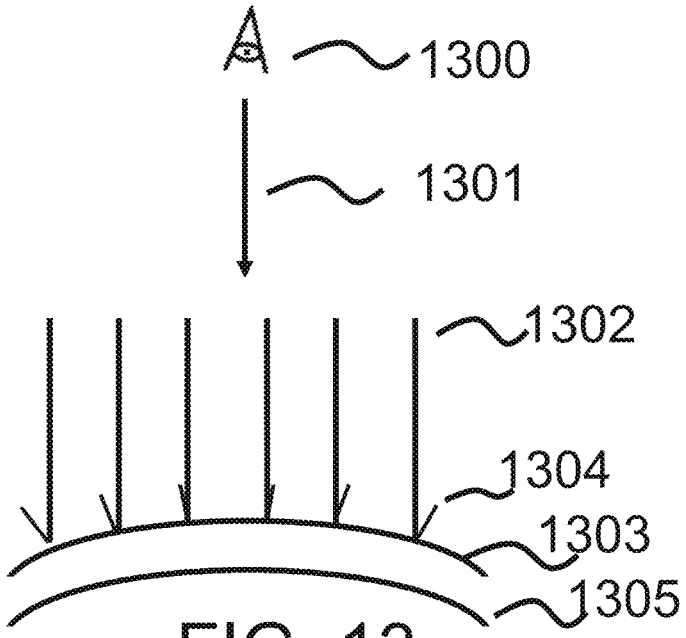
FIG. 13 shows a part of a curved surface moiré device with the revealing layer 1303, the base layer 1305 and the rays 1301 from the eye 1300 reaching 1302 the revealing layer surface obliquely in respect to its surface normal 1304.

In case of a lens supporting surface having a high curvature (FIG. 13, 1303), most rays 1302 from the eye to the lenses result in rays 1302 oblique in respect to the surface normal 1304. For these rays, the distance between the intersection of the ray with the lens supporting surface 1303 and the intersection with the base layer surface 1305 is larger than the corresponding distance in the case of a planar moiré.

In that case, it is advisable to choose a focal distance $f_d$ that is shorter than the standard focal length $f_s$, for example a focal distance $f_d$ that is for an index of refraction $n_s=1.5$ twice instead of three times the size of the lens curvature radius R. According to Eq, (17), in this case, the focal distance reduction factor is $k=\frac{2}{3}$. The substrate thickness will be set to $d=f_d-h$. As is mentioned in [Walger 2020], moirés and especially level-line moirés are to some extent tolerant to deviations in focal distance.

Figure 14:
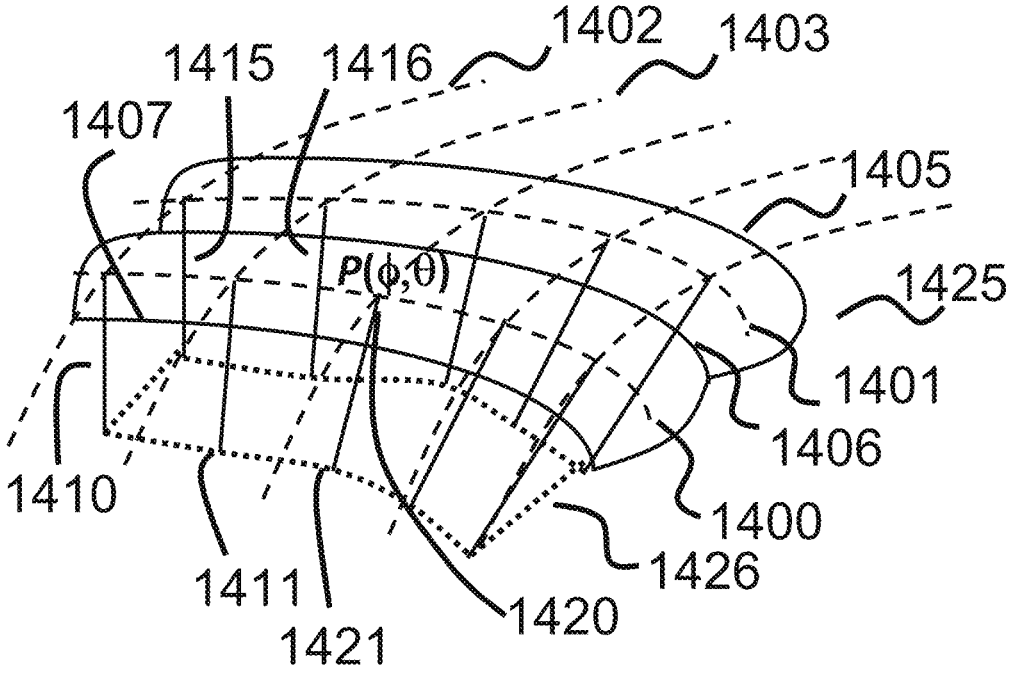
FIG. 14 shows part of an array of cylindrical lenses 1425 whose centers are laid out above isoparametric lines 1400 and 1401 and whose focal distances minus the sag-heights define the distances 1410 from revealer surface to base surface (1426: dotted lines)
Figure 15:
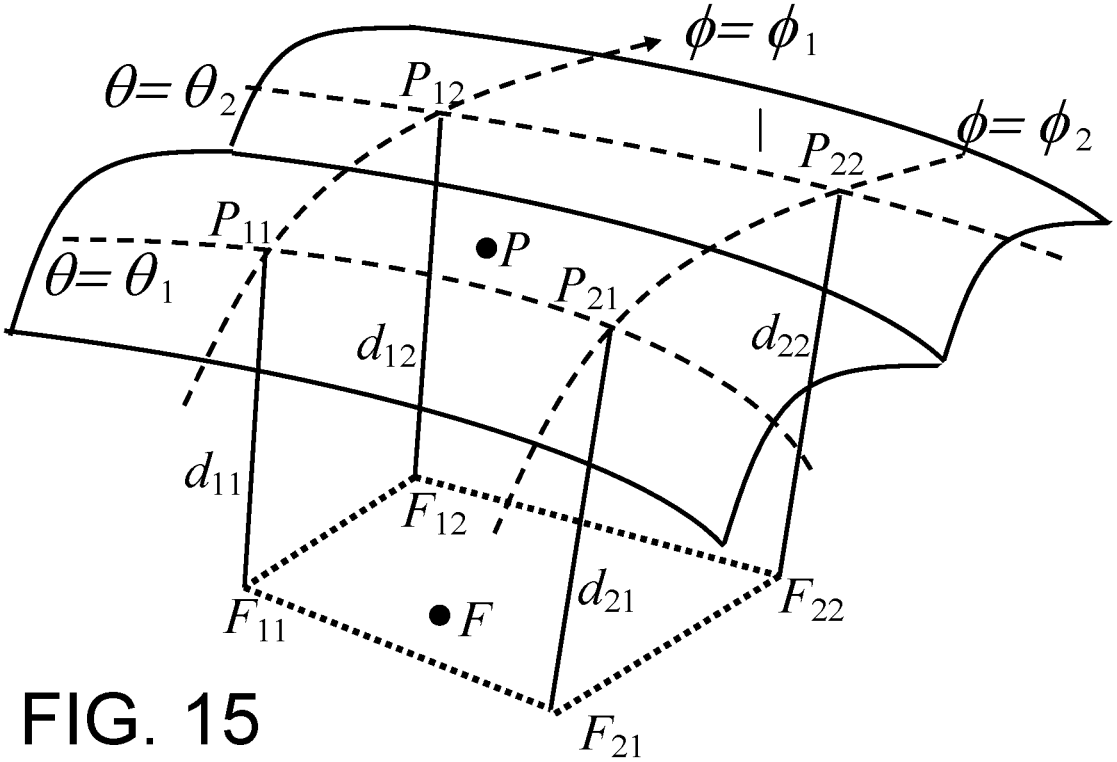
FIG. 15 shows an enlargement of FIG. 14, with points $P_{ij}$ at the intersections of the isoparametric lines of the revealer and the corresponding points $F_{ij}$ on the base layer surface.

FIG. 14 shows a general parametric curved surface with 3D coordinates given by P(ϕ,θ). The cylindrical lenses having borders 1407, 1406 and 1405, are laid out above isoparametric lines of constant θ values 1400 and 1401. The positions (FIG. 10, 1005, 1006) P(ϕ,θ) (1420) below the center of the top of the lenses, are located at the intersections 1420 of the two sets of isoparametric lines within the curved revealing layer lens support surface. At these positions, the selected focal distance, which is equal or smaller than the focal length defines the substrate thicknesses d(ϕ,θ). This substrate thickness defines the vertex locations F(ϕ,θ) (e.g. 1411, 1421) on or close to the base with which the base layer surface 1426 (dotted) is interpolated or fitted. This base layer surface is obtained by laying out a surface interpolating between or approximating the known $F(\phi,\theta)$ locations. A more detailed view is provided by FIG. 15, with vertices $P_{11}(\phi_1,\theta_1)$, $P_{12}(\phi_1,\theta_2)$, $P_{21}(\phi_2,\theta_1)$ and $P_{22}(\phi_2,\theta_2)$ located at the intersection of the isoparametric lines. For example, $P_{12}$ is located at the intersection of parameter lines ($\phi=\phi_1$, $\theta=\theta_2$). The corresponding substrate thicknesses $d_{11}$, $d_{12}$, $d_{21}$, $d_{22}$ are measured from points $P_{ij}$ along the normal to the curved lens supporting revealer surface and define points $F_{11}$, $F_{12}$, $F_{21}$, $F_{22}$ that are the locations along which the base layer surface is laid out. For example, the base layer surface can be formed by an interpolation surface composed of small bilinear interpolated facets through each set of points $F_{11}$, $F_{12}$, $F_{21}$, $F_{22}$ (also called base defining vertices). Other known interpolation or approximation techniques are possible, as long as the resulting base layer surface comes close to the base defining vertices $F_{11}$, $F_{12}$, $F_{21}$, $F_{22}$.

For each position F on the base, there is a corresponding position P on the revealer surface and therefore a corresponding pair of parametric coordinates $(\phi,\theta)$ that fulfill Eq. (21).

According to FIG. 12B, the visual result of the presented planar to spherical mapping is that the moiré becomes smaller when we come closer to the north pole, i.e. with increasing values of $\theta$. However, if the moiré is displayed not to far from the Equator on a small portion of a large sphere, the moiré will not be too much deformed and will therefore look nice.

There are many other mappings between a planar parametric surface and a lens supporting 3D surface. Suitable 3D surfaces for the creation of moirés are ruled surfaces, cylinders, paraboloids, cones, ellipsoids, helicoids, taurus, and hyperbolic paraboloids. Note that regions within object surfaces defined by meshes can also be approximated by parametrically defined surfaces. It is therefore possible to create moirés on nearly any kind of continuous surface.

Layout of a Level-Line Moiré on a Portion of a Sphere

Let us give as detailed example the synthesis of a level-line moiré on a portion of a sphere. According to the flowchart of FIG. 4, we first prepare a planar base 411 and a planar revealer 412. The mapping we adopt is Lambert's azimuthal equal area projection, see "Map projections, a Working Manual, US Geological Survey Professional Paper 1395, pp. 182-190.

The considered curved surface is a hemisphere. According to Lambert's equal area projection, a disk with a parametrization in polar coordinates $(q, \phi)$ and with a Cartesian coordinate system (u,v) is mapped onto the hemisphere (FIG. 16A).

Figure 16A:
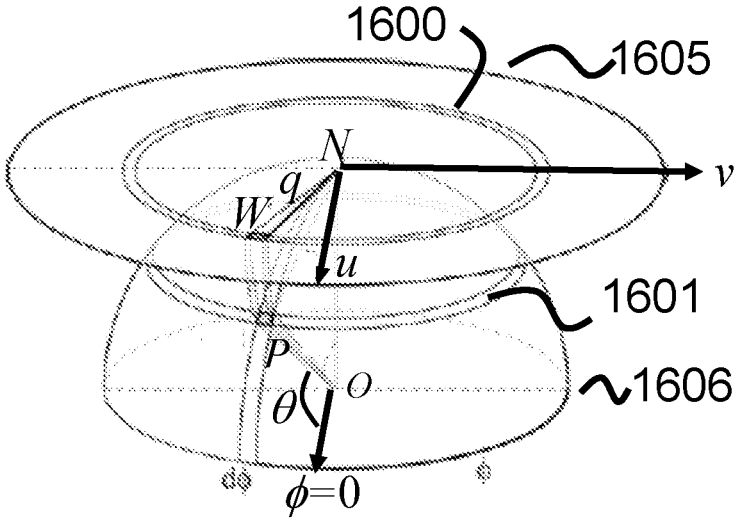
FIG. 16A shows according to the Lambert's azimuthal equal-area projection a planar disk 1605 and the corresponding hemispheric surface 1606.
Figure 16B:
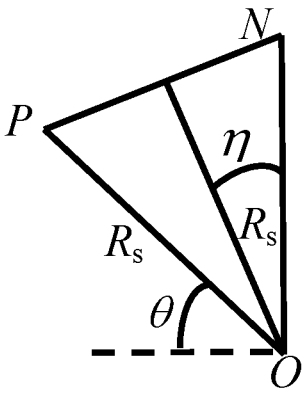
FIG. 16B shows an auxiliary drawing of part of a section through the hemisphere of FIG. 16A, with the triangle OPN and the corresponding angles.

The radial distance q of position W on the disk mapped onto a position P on the sphere is equal to the distance between position P and the north pole of the sphere N (see FIG. 16A). Let us calculate distance d from position $P=(\theta, \phi)$ on the sphere to the top of the sphere N, with $R_s$ being the radius of the sphere. Then, according to FIGS. 16A and 16B, we have the following relationships:

$$d = WN = PN = 2R_s\sin\left(\frac{\pi}{4} - \frac{\theta}{2}\right) = R_s\sqrt{2(1-\sin\theta)} \tag{23}$$

$$u = q^*\cos(\phi);\ v = q^*\sin(\phi);$$

In the case of a level-line moiré, the central revealer lines for the planar moiré (FIG. 4, 412) are conceptually positioned onto the disk as circles of constant radius q. They are at the center of the revealer rings on which the planar revealer lenses can be placed. One of these revealer rings is the one through point W (FIG. 16A, 1600). To a radius q on the disk corresponds an angle $\theta$ on the hemisphere (FIG. 16A) and a point P located on the corresponding hemisphere ring 1601.

Figure 17:
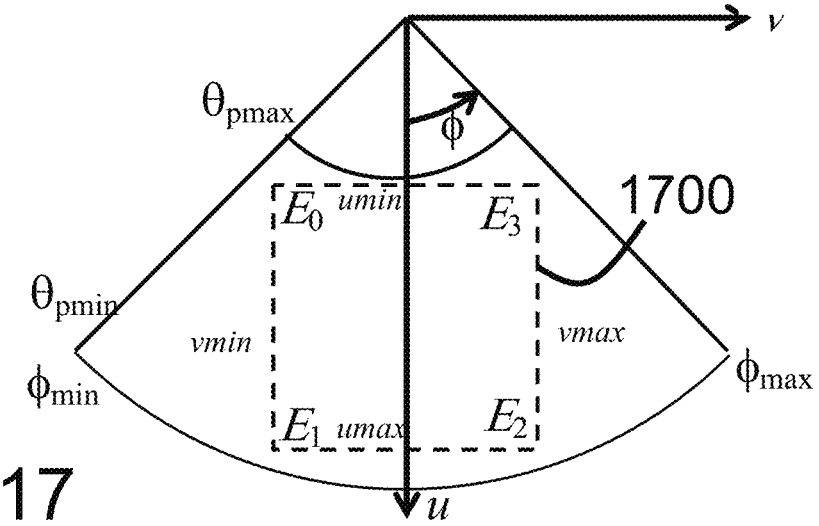
FIG. 17 shows a part of the planar disk associated with Lambert's azimuthal equal-area projection, with the positions $E_0$, $E_1$, $E_2$, $E_3$, defining the area where the elevation profile is laid out.
Figure 18:
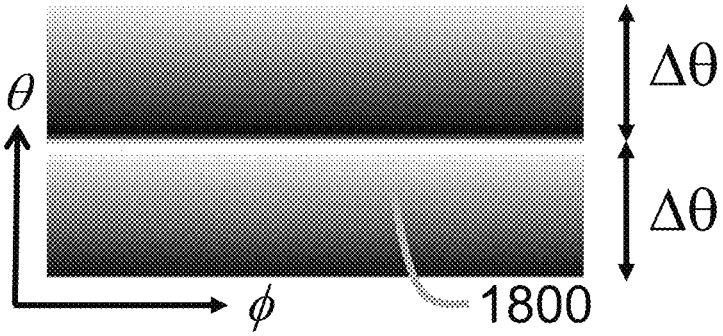
FIG. 18 shows a part of base layer base bands having in each band a continuous intensity wedge 1800.
Figure 19:
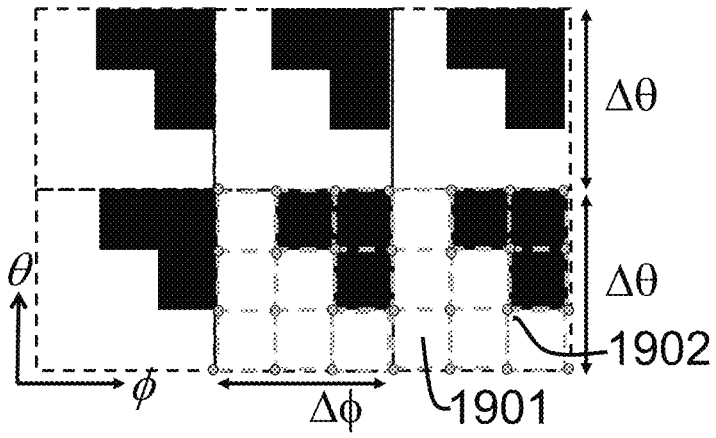
FIG. 19 shows a part of base layer base bands having in each band a halftone whose black foreground also forms a micro-shape.

Both the planar base layer 411, the planar revealer 412 and in addition for the level-line moiré, the elevation profile, are conceptually positioned within the planar area of the disk (FIG. 17) bounded by the vertices $E_0$, $E_1$, $E_2$, $E_3$. The unshifted base layer is formed by bands such as the ones shown in FIG. 18 and in FIG. 19. In FIG. 18, each band of the base has an intensity profile 1800, from black over gray to white. Instead of a continuous intensity profile, it is also possible to create a halftone such as the one shown in FIG. 19. Each azimuthal interval $\Delta\phi$ and ordinate interval $\Delta\theta$ contains several discrete quads 1901 that are either white or black. Quad vertices are located at the intersections 1902 of the quad borders (dashed in FIG. 19).

The elevation profile that is used for shifting the base layer lines is positioned (FIG. 17) as a square or rectangle 1700 directly onto the disk surface, with one of its sides parallel to axis u. The elevation profile is located between predefined minima $u_{min}$, $v_{min}$ and maxima $u_{max}$, $v_{max}$ of the coordinates u and v. These limits are defined by the designer. As shown in FIG. 16A, the disk is mapped onto the hemisphere. The area of interest 1700 of the disk is mapped into a corresponding area on the hemisphere. The revealer rings located on the disk 1600 are mapped to the corresponding revealer rings 1601 on the hemisphere. The cylindrical lenses are placed directly on these revealer rings.

Since the revealer rings have all the same repetition period $\Delta\theta$, they have cylindrical lenses of the same width w placed at their center. For example for a ring width w of 1.27 mm and a sphere radius $R_s$=120 mm, one obtains an angular period $40=2*\arcsin(w/(2R_s))=0.6064$ degree. Fulfilling the requirements of Eq. (18), a value of R=1 mm is chosen for the cylindrical lens curvature radius. According to Eq. (17), the sag-height is h=0.212 mm and the nominal focal length is $f_s$=3.212 mm. The angular field of view is according to Eq. (16) $\alpha$=78.8 degrees.

The base layer bands are placed beneath the revealing layer, at the same 0 angle, but at a distance from the center of sphere (FIG. 16A, O) reduced by the substrate thickness d. The substrate thickness depends on the focal distance, for example the standard focal length $f_s$ or a fraction of it (e.g. ⅔). According to Eq. (13) and with an index of refraction $n_s$=1.5, the focal length is $f_s$=3 mm. This yields a substrate thickness $d=f_s-h$=2.78 mm. In the case of a reduction of the focal distance in order to compensate for the obliqueness of the rays from the eyes to the revealer lenses, one may choose a focal length reduction factor k=⅔ which leads to a substrate thickness $d=\frac{2}{3}f_s-h$=1.78 mm.

To create the base layer on the hemisphere, we need to fit the base surface to the positions $F_{ij}$ defined by the normals (FIG. 15) through the centers of lenses and by the substrate thicknesses $d_{ij}$. Since in the present mapping, substrate thicknesses are equal at all positions of the considered region of the hemisphere, we can simply consider the base surface to be a hemisphere with radius $R_b=R_s-d$, i.e. it has the same origin as the initial lens supporting sphere surface. Its radius is the initial sphere radius minus the calculated substrate thickness. A similar Lambert equal area mapping exists between a corresponding "equal area disk" (FIG. 16A 1605) and that base layer sphere surface.

The base layer is created by traversing the $(\phi,\theta)$ space of the base hemisphere, from $\phi_{min}$ to $\phi$max and from $\theta$mm to $\theta_{max}$, with for example $\phi_{min}=-30°$, $\phi_{max}=+30°$, $\theta_{min}=0°$ and $=\theta_{max}=60°$. At each $(\phi,\theta)$ position, calculate the corresponding position on the disk in terms of (u,v) coordinate. For this purpose, using Eq. (23) and replacing $R_s$ by $R_b$, calculate the radial position q on the disk, and the (u,v) coordinate as a function of q and of the current azimuthal value $\phi$. If (u,v) is within the $u_{min}$, $v_{min}$ and $u_{max}$, $v_{max}$ bounds of the elevation profile, the current position within the elevation profile is calculated, the corresponding normalized elevation E(u,v) is read and the current position $(\phi,\theta)$ of the unshifted spherical base is shifted to the position $(\phi, \theta+(½)\cdot E(u,v)\cdot\Delta\theta)$. This means that the maximal value of the normalized elevation profile yields a base band shift of half an angular period. Smaller elevation values yield proportionally smaller base band shifts. The $(\phi,\theta)$ space is traversed in steps which are a few times smaller than the base band repetition period $\Delta\theta$, for example in angular steps $\delta\theta=\Delta\theta\cdot⅓$ and $\delta\phi=\Delta\theta\cdot⅓$, see FIG. 19, 1901.

Figure 20:
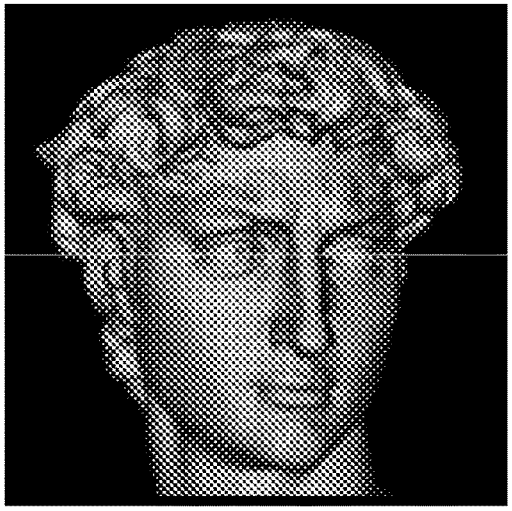
FIG. 20 shows an example of an elevation profile representing a face.
Figure 21A:
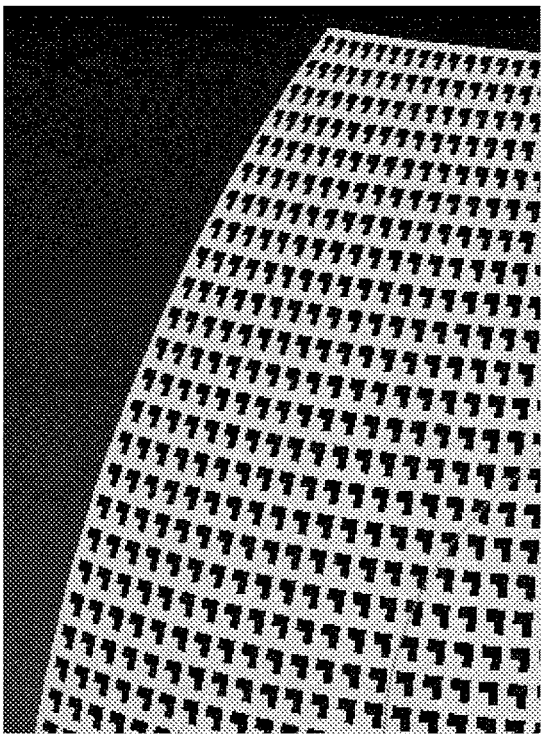
FIG. 21A shows a view of an unshifted base band layer laid out onto a portion of a sphere, where the base band halftone is the same as in FIG. 19.
Figure 21B:
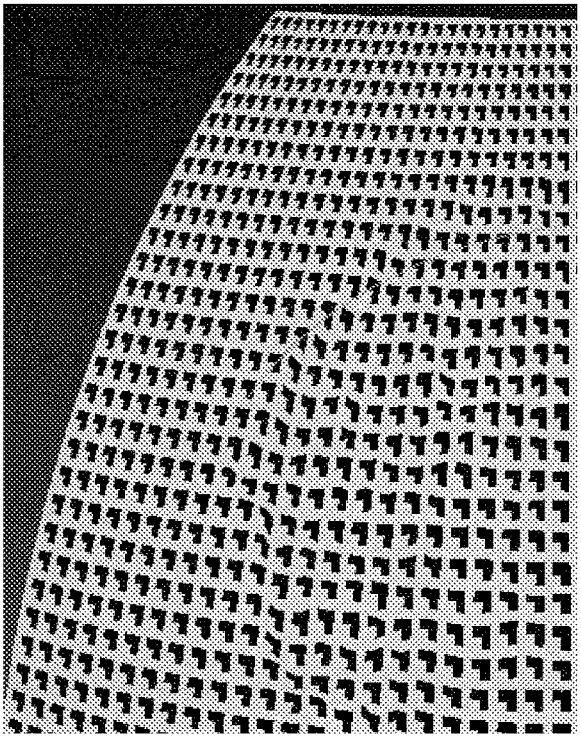
FIG. 21B shows a view of a base band layer laid out onto a portion of a sphere, where the base bands have been shifted perpendicularly to their isoparametric lines according to the elevation profile shown in FIG. 20, positioned on the disk as shown in FIG. 17.

As an example, FIG. 20 shows an elevation profile that represents the face of the "David" sculpture of Michelangelo. FIG. 21A shows the unshifted base layer laid out on its sphere portion, with unshifted base bands conceived according to the halftone shown in FIG. 19. FIG. 21B shows the same base layer, but with base bands shifted according to the elevation profile shown in FIG. 20. In the example of FIGS. 21A and 21B, for a sphere radius $R_s$=60 mm the angular repetition period is $\Delta\theta$=1.2128 degrees. It is the same angular repetition period for the revealer layer cylindrical lenses and for the base bands.

Figure 22:
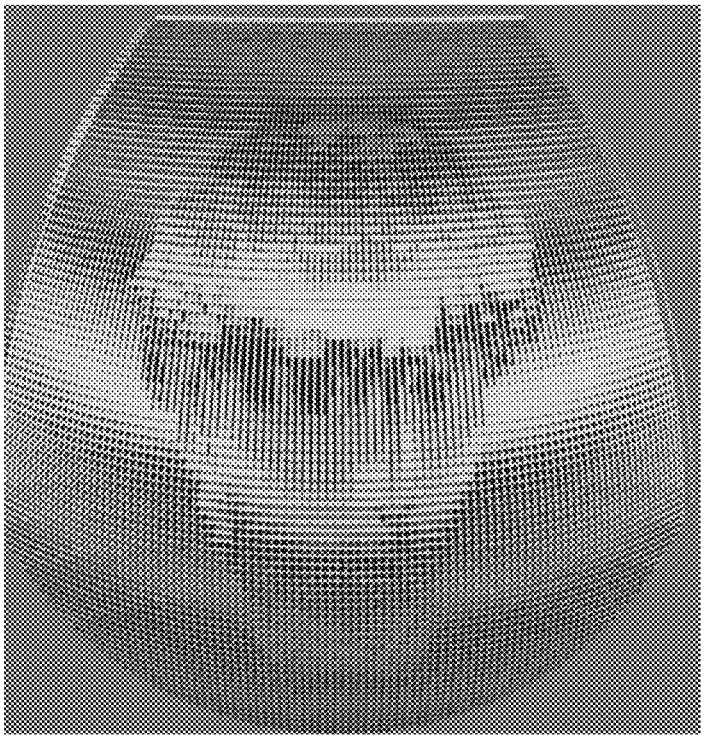
FIG. 22 shows a simulation of the superposition of the base layer shown in FIG. 21B and a revealing layer comprising a grating of cylindrical lenses laid out on the sphere along the isoparametric lines defined by ordinate $\theta$ being constant.

FIG. 22 shows a simulation of the superposition of base and revealer on a portion of the hemisphere. One can observe that the elevation profile of FIG. 20 is reproduced as moiré on the corresponding portion of the hemisphere. In this example, the sphere radius is $R_s$=120 mm and the angular repetition period is $\Delta\theta$=0.6061 degrees. The reproduced "David" head covers a relative large place, even at ordinate angles $\theta$ close to 60 degrees. This shows that placing the elevation profile on the equal area disk as shown in FIG. 17 compensates to some extent the shrinking distances of successive isoparametric abscissa lines on the hemisphere when moving closer to the North Pole.

Embodiments of the Present Invention

The present invention can be embodied by a number of different materials. The revealer lenses and the substrate should be transparent, and can be fabricated with plastic, glass or sapphire materials. The base layer should be able to produce a contrast, for example by having side by side on the background of the shapes either white diffusely reflecting or specular reflecting parts (e.g. FIG. 8B or FIG. 19, within white areas) and on the foreground non-reflecting parts such as absorbing parts, light attenuating parts or holes (e.g. FIG. 8B or FIG. 19, within black areas). In case of a metallic base layer, one can have specular reflections for the white background areas and diffuse reflections for the black foreground areas of the micro-shapes or vice-versa. Specular reflections are obtained by flat parts and diffuse reflections by parts with tiny valley structures that partly absorb and partly reflect light in different directions.

Figure 23:
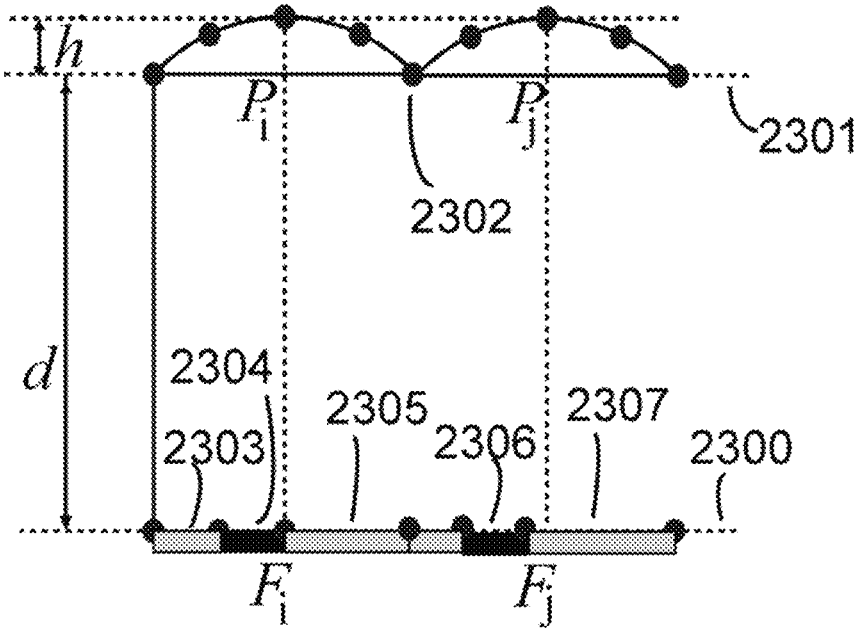
FIG. 23 shows the revealer lenses and the base layer 2300, where the base layer is formed by bands of micro-shapes obtained by having a contrast between the shape background 2303, 2305 and the shape foreground 2304, 2306.
Figure 24:
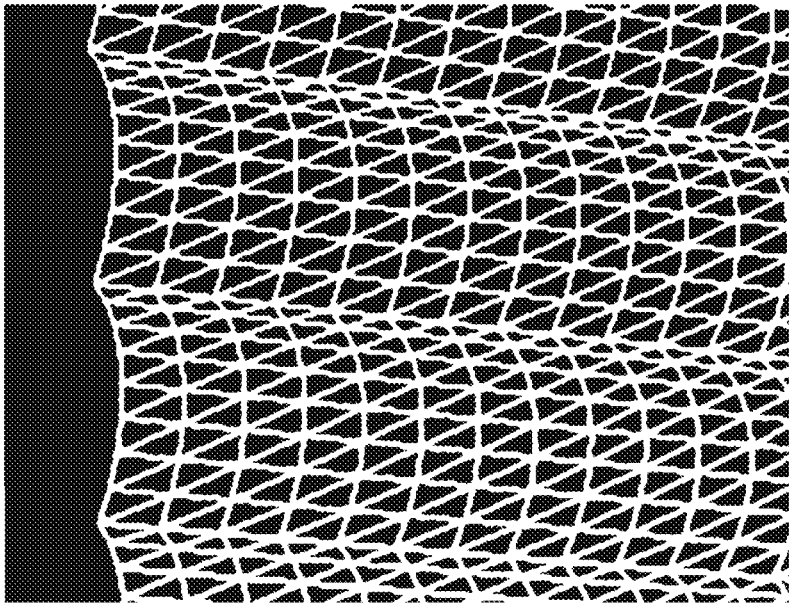
FIG. 24 shows a part of the mesh that describes a revealer with cylindrical lenses.

With a 3D printer, one can create a composed layer formed by the revealer lenses, the substrate and the base layer micro-shapes. In reflection mode, on the base layer side of the composed layer, the foreground of base micro-shapes is realized by dark plastic material and the background realized by white reflecting material. In transmission mode, the background is realized with transparent material. The revealer lenses together with the substrate can be 3D printed with a transparent plastic material. In order to print with a 3D printer, the device composed of base and revealer can be defined as a surface mesh, for example in the Wavefront "obj" format. FIG. 23 shows a section of a device composed of a revealer 2301 and a base 2300, similar to FIG. 10, but with marked positions (black small disks 2302) representing vertices that are part of the surface mesh. In addition, FIG. 23 shows schematically the base layer with its bright areas 2303, 2305 2307 and dark areas 2304, 2306 that create a strong contrast. FIG. 24 shows part of the triangle mesh generated for the revealing layer cylindrical lenses.

In order to produce large quantities of an object incorporating a curved surface moiré, it is possible to create a mold that is the negative of the base and revealer composed layer and use it to industrially produce for example by injection molding large quantities of the composed plastic base and revealer device. The composed device can then be attached or pasted to the object that is to be decorated.

Objects Decorated by Moirés

Figure 25:
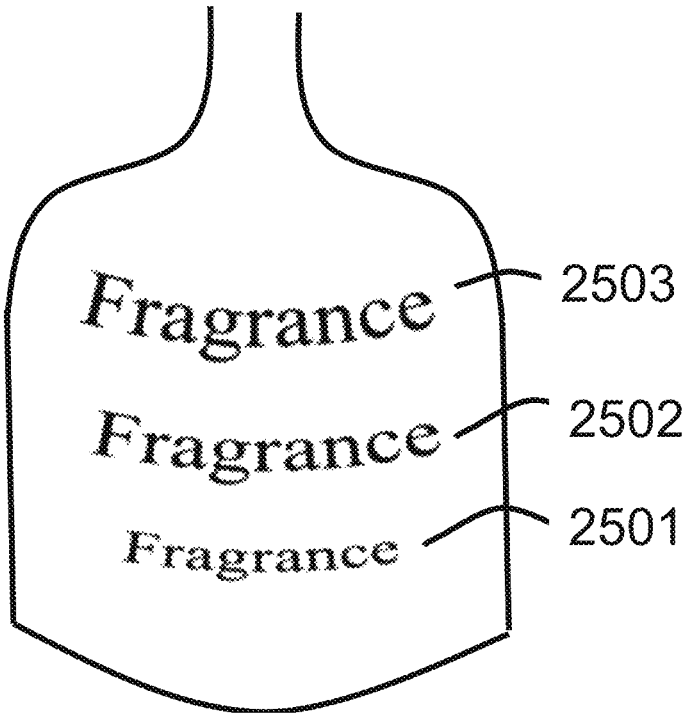
FIG. 25 shows a bottle, with a 1D surface moiré where by tilting the bottle, the 1D moiré moves from position 2501 to 2502 and from position 2502 to 2503 and at the same time enlarges its shape, similarly to FIG. 3.

Daily life objects that have curved surface parts are numerous. Bottles for example have often a cylindrical shape. With the presented method, a computer program can create on a cylindrical surface the base and revealer that form a composed layer to be pasted or attached onto the bottle that is to be decorated. Objects with more complex curved surfaces comprise bottles of perfumes, bottles for alcoholic and non-alcoholic drinks, and bottles for fashionable drinks. These bottles can be made of glass, plastic, aluminium or other materials. FIG. 25 shows a bottle with at its center a moiré created on the curved surface moving in the vertical direction from position 2501, to 2502 and to 2503, and at the same time enlarging itself.

Figure 26:
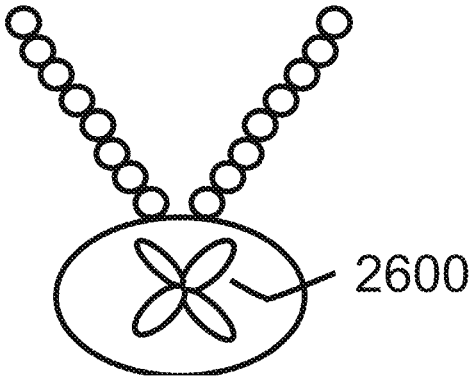
FIG. 26 shows a necklace where the curved 1D moiré 2600 is a flower that rotates upon movement of the necklace.
Figure 27:
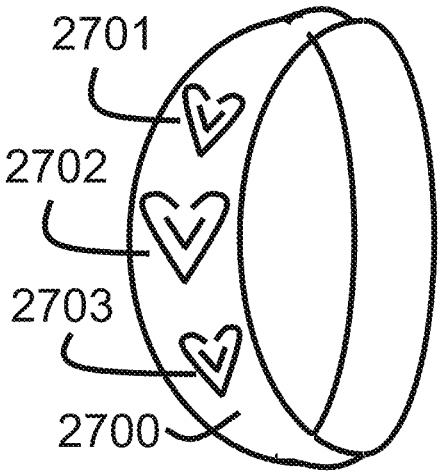
FIG. 27 shows a bracelet, where the curved 1D moiré moves and changes its size between positions 2703, 2702 and 2701.

Further objects comprise fashion clothes or cars which could incorporate decorative areas with surface moirés. Other objects comprise jewelry and watches, where small curved surfaces can be decorated by 1D moiré, 2D moiré or level-line moirés. Such jewelry objects comprise bracelets (FIG. 27), rings, brooches and necklaces (FIG. 26). Other luxury objects have often an ellipsoid shape. The moiré can be created on such surfaces in a similar manner as for spheres. In the necklace example (FIG. 26), the moiré 2600 is a flower that rotates upon movement of the necklace. In the bracelet example (FIG. 27), when the hand carrying the bracelet moves, the moiré heart shape moves up or down between positions 2701, 2702 and 2703 and also changes its size and appearance. The superior surface 2700 of the bracelet is curved.

Figure 28:
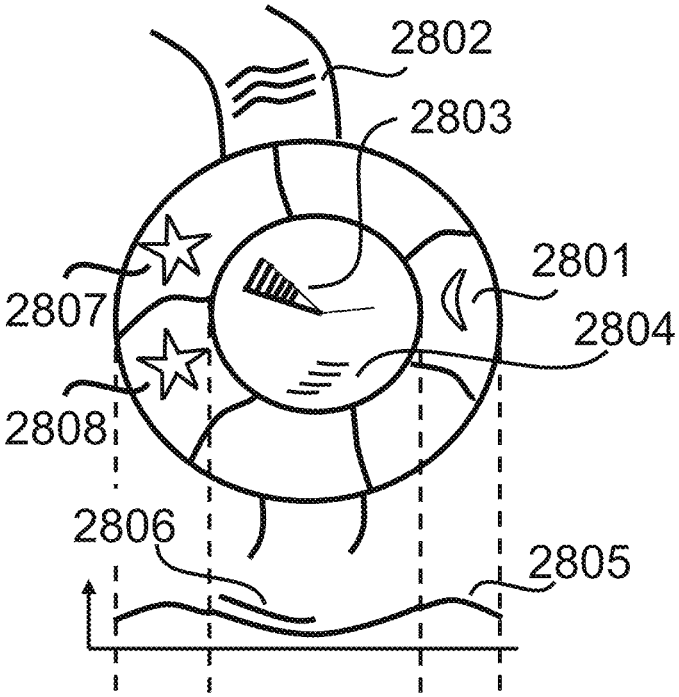
FIG. 28 show a watch with different kinds of curved surface moirés: the "moon" 2801 is a level-line moiré showing a beating effect, 1D moiré star shapes 2807, 2808 move from one position to the other when the watch is tilted, the minute hand 2803 incorporates as revealing layer geometrically transformed cylindrical lenses which when superposed to the corresponding geometrically transformed base bands generate a visible slightly moving or beating "6" number shape.

Watches also have curved surface parts. Surfaces on or beneath the housing may be curved. For example, FIG. 28 shows the height profile 2805 of a horizontal section through the center of the watch. On the exterior part, there is a "moon" 2801 within which thanks to the level-line moiré a beating effect is achieved. There are also 1D moiré star shapes 2807, 2808 that move from one position to the other when the watch is tilted. And finally there is the minute hand that embodies as revealer geometrically transformed cylindrical lenses laid out as part of a spiral which when superposed to the corresponding geometrically transformed base bands 2804 generates a visible slightly moving or beating "6" number shape. The minute hand (FIG. 28, 2803, 2806) is curved and the underlying base layer surface 2805 is also curved. Finally, thanks to the 1D moiré, some waves 2802 move as moiré up or down on the armband.

A further object that could benefit from the beauty of dynamically moving or beating moiré shapes is a lampshade (FIG. 29). The lampshade is illuminated from its interior

2902, light is attenuated by the lampshade and reaches the exterior of the lamp. On a part of the cylindrical, spherical or conical lampshade 2900, a composed base and revealer 2901 can be attached.

Similarly, an illumination device (FIG. 30) located on a street or a public park can have an envelope 3000 that diffuses the emitted light 3002 to the surrounding areas. This envelope can incorporate a composed base and revealer 3001 showing to the person walking by the moving shape of the logo of the town.

On the examples mentioned above, the curved revealing layer may instead of a grating of cylindrical or spherical lenses be embodied by a grating of transparent lines or transparent disks.

Creating a Curved Surface Moiré

Let us give an overview of the steps that need to be carry out in order to conceive a curved surface moiré ready to be fabricated. Some of the steps such as definitions may be performed interactively by a designer. Other steps involving for example computations of parameters according to specific formula or the creation of meshes are preferably performed automatically by software modules running on a computer.

The considered steps are as follows:

- Select an object on which a dynamically evolving moiré should be produced (to be carried out by a designer);
- Select a 3D surface and within that surface an area that will contain the moiré and that can be easily placed or pasted onto the target object (partly by the designer and partly by software for preview);
- Define for the considered 3D surface area a mapping between a planar surface with (u,v) or (ϕ,θ) coordinates and the 3D surface expressed by (x,y,z) coordinates (partly by the designer and partly by software for preview);
- Select the type of desired moiré effect: either a 1D or 2D moiré for a moving shape or a level-line moiré for a moiré shape showing beating effects (by the designer);
- According to the desired moiré effect (1D, 2D or level-line), conceive on the planar surface a moiré shape, a moiré layout and a moiré evolution that is close to the one desired on the curved surface. If for a 1D or a 2D moiré, the moiré layout is not rectilinear but curvilinear, select the geometric transformation to be applied to the moiré shape in order to ensure a desired layout of the moiré as well as the nature of its displacement. Such a geometric transformation brings a rectilinear moiré shape into a curvilinear moiré shape (partly by the designer and partly by software for preview);
- Select also the planar layout of the revealing layer lenses: either rectilinear cylindrical lenses or geometrically transformed curvilinear cylindrical lenses (partly by the designer and partly by software for preview);
- With the definition of the layouts of the moiré layer and the revealing layer according to their respective geometric transformations, calculate the layout of the base layer, i.e. the transformation that maps the transformed base layer back into the rectilinear original base layer as well as its inverse (calculations performed by computer);
- Now that the layouts of both the base and revealer are known, according to their respective geometric transformations $H(x_t, y_t)$ and $G(x_t, y_t)$, the next step is a first mapping which maps the revealing layer surface from planar (ϕ,θ) or (u,v) coordinates to the curved revealing layer expressed in (x,y,z) 3D surface coordinates (performed by computer);
- The distance between consecutive parameter lines of the curved revealer lens supporting surface defines the lens size (cylindrical lens width or spherical lens size) at the current position as well as the corresponding focal distance (performed by computer);
- Define a second mapping between planar base layer surface and curved base layer surface by fitting the base layer surface at a distance of the revealer lens surface corresponding to the selected focal distance (performed by computer);
- Activate the software module that performs the operations necessary to create the mesh that describes the curved piece of moiré surface composed of base and revealer by accounting for the design of the moiré in the original space, for the calculated geometric transformations of base and revealer as well as for the mapping from planar parametric space to the 3D surface (performed by computer);
- With a mesh verification package such as Meshlab verify the quality of the mesh produced by the previous step. Verify also the quality of the resulting moiré shape by simulating a light source illuminating the moiré device from the front for a moiré in reflection and from the back for a moiré in transmission. Use as simulation software the well-known Blender or a similar software package (performed by the designer with the help of the software package);
- After verification, the mesh is ready for fabrication. Fabrication can be carried out by sending the composed base and revealing layers laid out on a curved surface to a 3D print system. Consider the resulting 3D print to be an individual prototype;
- For mass production, produce a mold for injection molding of plastic. Such a mold made of metal can be produced from the mesh description either by CNC machining or by a spark erosion process carried out with an electrical discharge machining equipment.

Inventive Elements

The presented method for producing moirés on curved surfaces comprises the following inventive elements.

- Applying first linear or non-linear geometric transformations to obtain the planar base and revealer creating a desired planar moiré resembling the desired curved moiré.
- Applying a first mapping to map the planar revealer onto the target curved surface. As a result of a non-linear geometric transformation and of a planar to 3D surface mapping, the resulting moiré takes the shape of the curved surface and at the same time evolves in a non-linear manner on this curved surface.
- Assigning dimensions to the revealer lenses that depend on the space between the isoparametric lines of the curved surface and that keep the angular field of view constant.
- According to these lens dimensions and to a focal length reduction factor, determining the focal distance between the lens top surface and the base layer.
- In case of a level-line moiré, there is no necessity to position the elevation profile along the isoparametric lines. Therefore, to some extent, the deformation due to the mapping between planar surface and curved surface can be compensated for.

Further Decorative Aspects

Moirés on curved surfaces can, in addition to the decoration of objects, also be created at a large scale for exhibitions or for amusement parks. They also may find applications for the decoration of buildings. At these large scales, the revealing layer gratings may be formed by transparent lines or transparent bands. Then moirés in reflectance or in transmittance may be seen from a considerable distance (from one meter to hundred meters depending on the size of the curved moiré). In case of a moiré in transmittance, the base layer can be conceived by dark elements for the background and by transparent elements or holes for the foreground of the shapes forming the base layer bands or vice-versa.

The invention claimed is:

1. A method for creating moiré shapes on a 3D curved surface formed by superposing a curved base layer and a curved revealing layer, where the curved revealing layer comprises a grating of cylindrical or spherical lenses and where the curved base layer comprises a grating of base bands, the method comprising the steps of:

(i) creating a layout of a moiré incorporating said moiré shapes in a planar space;

(ii) defining a layout of a planar revealing layer in said planar space;

(iii) computing a layout of a planar base layer in said planar space as a function of the layout of the planar revealing layer;

(iv) defining a first mapping between the planar space and a desired target 3D curved surface and applying said first mapping to the planar revealing layer in order to obtain said curved revealing layer laid out onto the desired 3D curved surface;

(v) according to space between neighbouring isoparametric lines, defining dimensions of the lenses and positioning the lenses on top of the revealing layer;

(vi) applying a second mapping in order to map the planar base layer into the curved base layer located beneath the revealing layer;

(vii) creating with the curved base layer and the curved revealing layer a mesh object that is ready for fabrication.

2. The method of claim 1, where focal lengths of the revealing layer lenses are deduced from the dimensions of the lenses and where the second mapping places the base layer surface at focal distances from the curved revealing layer surface that are equal or smaller than the focal lengths.

3. The method of claim 1, where on the curved revealing layer, the lenses are laid out along isoparametric lines of the target curved surface and where defining the dimensions of the lenses comprises setting the lens curvature radius so as to obtain a constant angular field of view for lenses that are part of the revealing layer.

4. The method of claim 1, where the moiré shapes created on the curved surface form a level-line moiré which upon change of observation angle shows a beating effect, where in said planar space an elevation profile is also placed, where the layout of the planar base layer is also computed as a function of an elevation profile by having the base bands of said planar base layer shifted according to said elevation profile and where said shifted base bands are mapped by said second mapping into the base bands of the curved base layer.

5. The method of claim 1, where the moiré shapes created on the curved surface form a 1D or 2D moiré, where upon change of observation angle said moiré shapes displace themselves from one location to another location of the curved surface and where the layout of the planar base layer is also computed as a function of the layout of the moiré in said planar space.

6. The method of claim 5, where the base bands of the planar base layer are curvilinear and are obtained by a geometric transformation from rectilinear base bands and where applying the second mapping brings the curvilinear planar base bands onto the curvilinear curved base bands located on the curved base layer.

7. The method of claim 1, where the base bands are formed by micro-shapes that are either scaled down or scaled down and deformed instances of said moiré shapes, selected from a set of letters, numbers, symbols, and graphical elements.

8. The method of claim 1, where the resulting mesh object is formed by or attached to an object selected from a set of bottles of perfumes, bottles of alcoholic drinks, bottles of non-alcoholic drinks, bottles of fashionable drinks, watches, bracelets, rings, brooches, necklaces, lampshades, fashion clothes and cars, and where the fabrication comprises processes selected from a set of 3D printing, computer driven machining, electro-erosion, and injection molding.

9. A curved surface formed by a superposition of a curved base layer and a curved revealing layer, where the curved surface is either defined by a parametric mapping from planar space to 3D space or by a non-planar surface mesh, where the curved surface shows a moiré shape, where the curved base layer comprises base bands, where the curved revealing layer comprises a grating of sampling elements selected from a set of cylindrical lenses, spherical lenses, transparent lines, transparent disks and holes, where upon change of observation angle the moiré shape dynamically evolves, where the moiré shape is recognizable by a human being, where in case said base bands are locally shifted, the moiré shape's evolution is a beating effect characterized by successive intensity values appearing on level-lines of said moiré shape and where in case said base bands are not locally shifted, they comprise micro-shapes that are obtained by a geometric transformation of the moiré shape and the moiré shape's evolution comprises a displacement from one position to another position of said curved surface.

10. The curved surface of claim 9, where the moiré shape is selected from a set of words, letters, numbers, flags, logos, graphic motifs, drawings, clip art, faces, houses, trees, humans and animals.

11. The curved surface of claim 9 located on a valuable object selected from a set of bottles, watches, bracelets, rings, brooches, necklaces, lampshades, fashion clothes, cars, lampshades, illumination devices, and buildings.

12. An apparatus for producing a 3D curved surface showing moiré shapes, where the 3D curved surface is formed by the superposition of a curved base layer and a curved revealing layer, where the curved revealing layer comprises a grating of cylindrical or spherical lenses and where the curved base layer comprises a grating of bands, where the grating of lenses samples locations on the curved base layer surface, the apparatus comprising:

(i) a computer operable for executing software modules, said computer comprising a CPU, memory, disks and a network interface;

(ii) a software module for preparing in a planar parametric space within the computer memory a layout of the base and revealing layers from which layouts of the curved base layer and of the curved revealing layers are derived;

(iii) a software module for specifying a first mapping between the planar parametric space and the desired target 3D curved surface and for applying said first mapping to the planar revealing layer in order to obtain said curved revealing layer;

(iv) a software module which according to the space between neighbouring isoparametric lines defines the dimensions of the lenses;

(v) a software module for positioning the lenses on top of the curved revealing layer surface according to their dimensions;

(vi) a software module for applying a second mapping of the planar base layer into the curved base layer by placing the base layer surface beneath the curved revealing layer surface;

(ix) a software module for creating with the resulting curved base layer and curved revealing layer a mesh object that is ready for fabrication.

13. The apparatus of claim 12 where focal lengths of the revealing layer lenses are deduced from the dimensions of the lenses and where the second mapping places the base layer surface at focal distances from the curved revealing layer surface that are equal or smaller than the focal lengths.

14. The apparatus of claim 12 where the curved revealing grating of lenses is laid out along one set of isoparametric lines mapped onto the target curved surface and where ratios between lens widths and lens curvature radii are constant, thereby ensuring a constant angular field of view for lenses at different positions of the revealing layer.

15. The apparatus of claim 12 where the moiré shapes created on the curved surface form a level-line moiré which upon change of observation angle shows a beating effect, where in said planar space an elevation profile is also placed, where the grating of bands of said planar base layer is made of base bands shifted according to elevations of said elevation profile and where said shifted base bands are mapped by said second mapping into the curved base layer.

16. The apparatus of claim 12, where the moiré shapes created on the curved surface form a 1D or 2D moiré, where upon change of observation angle said moiré shapes displace themselves from one location to another location of the curved surface and where the base bands are formed by micro-shapes obtained by transformation from the moiré shapes, said moiré shapes being selected from a set of letters, numbers, symbols, and graphical elements.

17. The apparatus of claim 16, where the base layer base bands are obtained by a geometric transformation from planar rectilinear base bands to planar curvilinear base bands and where applying the second mapping brings the curvilinear planar base bands onto the curvilinear curved base bands located on the curved base layer.

18. The apparatus of claim 16, where the resulting mesh object is formed by or attached to an object selected from a set of bottles, watches, bracelets, rings, brooches, necklaces, lampshades, fashion clothes, cars, lampshades and illumination devices and where the fabrication comprises processes selected from 3D printing, computer driven machining, electro-erosion, and injection molding.

* * * * *